US011073774B2

(12) United States Patent
Yamada et al.

(10) Patent No.: US 11,073,774 B2
(45) Date of Patent: Jul. 27, 2021

(54) CARTRIDGE AND IMAGE FORMING APPARATUS

(71) Applicant: CANON KABUSHIKI KAISHA, Tokyo (JP)

(72) Inventors: Jiro Yamada, Tokyo (JP); Joji Goto, Tokyo (JP); Shota Nakamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/022,263

(22) Filed: Sep. 16, 2020

(65) Prior Publication Data

US 2021/0080868 A1 Mar. 18, 2021

(30) Foreign Application Priority Data

Sep. 17, 2019 (JP) ..... JP2019-168876

(51) Int. Cl.
*G03G 15/08* (2006.01)

(52) U.S. Cl.
CPC ..... *G03G 15/0886* (2013.01); *G03G 15/0867* (2013.01)

(58) Field of Classification Search
CPC ..... G03G 15/0867; G03G 15/0886
USPC ..... 399/107, 110, 111, 119, 120, 262, 258, 399/260
See application file for complete search history.

(56) References Cited

U.S. PATENT DOCUMENTS 8,588,659 B2 * 11/2013 Carter ..... G03G 21/1676 399/258
9,188,949 B2 * 11/2015 Sato ..... G03G 21/1642
9,298,134 B2 * 3/2016 Okubo ..... G03G 15/0886
9,740,139 B2 * 8/2017 Hosokawa ..... G03G 15/0872
2013/0078004 A1 3/2013 Matsumoto
2014/0153974 A1 6/2014 Jimba
(Continued)

FOREIGN PATENT DOCUMENTS

JP 2006-227097 A 8/2006
JP 2008-134526 A 11/2006
(Continued)

OTHER PUBLICATIONS

Feb. 18, 2021 Extended Search Report in European Patent Application No. 20196373.5.

*Primary Examiner* — Hoan H Tran
(74) *Attorney, Agent, or Firm* — Venable LLP

(57) ABSTRACT

A cartridge attachable to an apparatus main body of an image forming apparatus, the apparatus main body having a restricting portion and to which the cartridge is mounted by being moved from a unmounted position to a mounting-completed position in a first direction, the cartridge includes a developer container provided with a supply port, and a shutter movable between an opening position for opening the supply port and a closing position for closing the supply port, having a restricted portion, and configured to be in the closing position when the cartridge is in the unmounted position and be in the opening position when the cartridge is in the mounting-completed position, wherein a movement of the shutter in a second direction perpendicular to the first direction is restricted by an engagement between the restricting portion and the restricted portion when the cartridge is in the mounting-completed position.

25 Claims, 19 Drawing Sheets

(56) References Cited

U.S. PATENT DOCUMENTS

| | | | |
|---|---|---|---|
| 2017/0097587 | A1 | 4/2017 | Inada |
| 2019/0377283 | A1 | 12/2019 | Suzuki et al. |

FOREIGN PATENT DOCUMENTS

| | | | |
|---|---|---|---|
| JP | 2009-069231 | A | 4/2009 |
| JP | 2015-068879 | A | 4/2015 |
| JP | 2018-101157 | A | 6/2018 |
| JP | 6407322 | B2 | 10/2018 |
| JP | 2019-095707 | A | 6/2019 |

* cited by examiner

CARTRIDGE AND IMAGE FORMING APPARATUS

BACKGROUND OF THE INVENTION

Field of the Invention

The present invention relates to a developer replenishing cartridge that is used to replenish a developer in an image forming apparatus and to an image forming apparatus that forms an image on a recording material using a developer.

Description of the Related Art

Conventionally, among image forming apparatuses such as copiers, facsimile machines, printers, and all-in-one printers which perform image formation by an electrophotographic system, apparatuses which adopt a so-called process cartridge system are known. In addition, there are configurations in which, in order to replenish toner that is consumed with image formation, a toner replenishing cartridge that houses the toner is provided separately from the process cartridge so as to be attachable to and detachable from an image forming apparatus main body. In such a configuration, the toner replenishing cartridge individually supplies toner to the process cartridge of each color. Furthermore, among such toner replenishing cartridge configurations, there is a configuration in which a toner transport apparatus is provided in an image forming apparatus main body (Japanese Patent No. 6407322). In Japanese Patent No. 6407322, the toner replenishing cartridge is provided with a toner supply port for supplying toner, and the process cartridge is provided with a toner receiving port for receiving toner. The toner having been supplied from the toner supply port is supplied via the toner transport apparatus and the toner receiving port to the process cartridge.

In addition, image forming apparatuses of this type are generally configured such that the toner supply port and the toner receiving port are provided with an openable and closable shutter for preventing toner leakage and restricting supply or intake of toner. The shutter adopts a configuration which causes the shutter to work in conjunction with an attaching/detaching operation of the process cartridge or the toner replenishing cartridge to/from the image forming apparatus main body and to open/close in a direction parallel to a mounting direction (a direction of an arrow B) (Japanese Patent Application Laid-open No. 2008-134526).

However, in a configuration in which the shutter opens or closes in conjunction with an attaching or detaching operation of a cartridge as described above, there is a risk that toner may leak due to a displacement in the mounting position of the cartridge. In order to address such problems, a method such as causing a guide on a toner supply-side to engage with a guide rail on a toner receiving-side in order to enhance relative positional accuracy between the toner receiving port and the toner supply port is adopted (Japanese Patent Application Laid-open No. 2009-69231).

SUMMARY OF THE INVENTION

However, in a shutter opening/closing mechanism in toner replenishment as described above, there is a large number of interposing parts between a toner receiving port provided on an image forming apparatus main body and a toner supply port provided on a toner replenishing cartridge. Therefore, the difficulty of ensuring accuracy of relative positions of hole positions of the toner receiving port and the toner supply port requires that the holes be enlarged, resulting in cases where an attaching or detaching operation of the toner replenishing cartridge causes the inside of the image forming apparatus to be contaminated with toner.

An object of the present invention is to provide a technique that enables reducing toner scattering and toner contamination during an attaching or detaching operation of a toner replenishing cartridge to or from an image forming apparatus main body.

In order to achieve the object described above, a cartridge according to the present invention attachable to and detachable from an apparatus main body of an image forming apparatus, the apparatus main body having a restricting portion and to which the cartridge is mounted by being moved from a unmounted position to a mounting-completed position in a first direction, the cartridge comprising:

a developer container which houses a developer and provided with a supply port for supplying the developer to the apparatus main body; and a shutter configured to be movable, with respect to the developer container, between an opening position for opening the supply port and a closing position for closing the supply port, the shutter having a restricted portion and being configured to be in the closing position when the cartridge is in the unmounted position and be in the opening position when the cartridge is in the mounting-completed position, wherein a movement of the shutter in a second direction perpendicular to the first direction is restricted by an engagement between the restricting portion of the apparatus main body and the restricted portion when the cartridge is in the mounting-completed position.

In order to achieve the object described above, an image forming apparatus according to the present invention, comprising:

an apparatus main body including an image forming portion that forms an image on a recording material using a developer and a receiving port for receiving replenishment of the developer; and a cartridge attachable to and detachable from the apparatus main body, the apparatus main body having a restricting portion and to which the cartridge is mounted by being moved from a unmounted position to a mounting-completed position in a first direction, the cartridge comprising:

a developer container which houses a developer and provided with a supply port for supplying the developer to the apparatus main body; and a shutter configured to be movable, with respect to the developer container, between an opening position for opening the supply port and a closing position for closing the supply port, the shutter having a restricted portion and being configured to be in the closing position when the cartridge is in the unmounted position and be in the opening position when the cartridge is in the mounting-completed position, wherein a movement of the shutter in a second direction perpendicular to the first direction is restricted by an engagement between the restricting portion of the apparatus main body and the restricted portion when the cartridge is in the mounting-completed position.

According to the present invention, relative positional accuracy between a supply port provided on a replenishing cartridge and a receiving port provided on an apparatus main body-side can be enhanced and, since diameters of holes can be reduced, toner scattering and toner contamination during an attaching or detaching operation of the replenishing cartridge can be prevented.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 2:
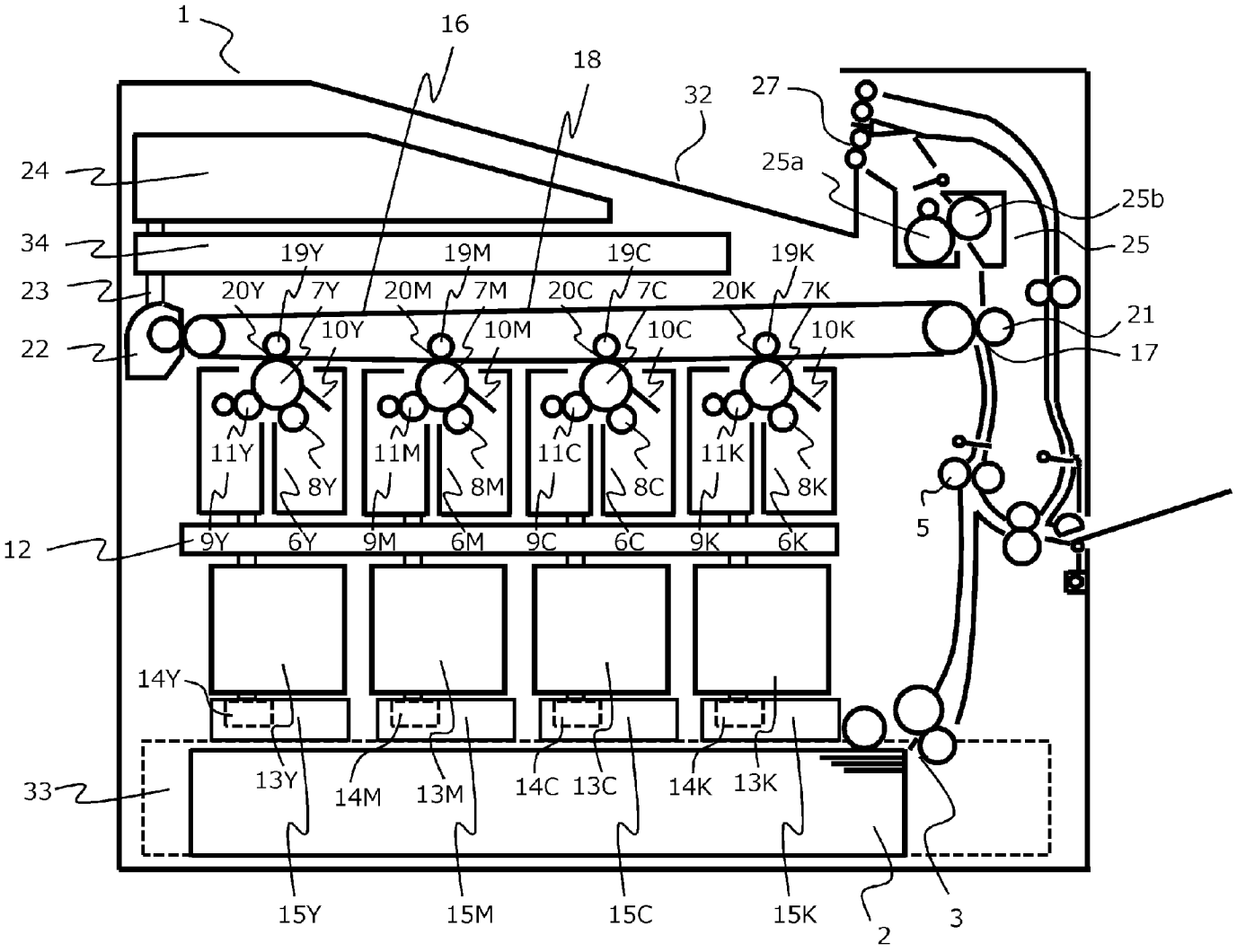
FIG. 2 is a schematic sectional view showing an overall configuration of an image forming apparatus according to the first embodiment.

An image forming apparatus 1 according to a first embodiment of the present invention will be described with reference to FIG. 2. FIG. 2 is a schematic sectional view showing an overall configuration of the image forming apparatus 1 and is a sectional view when the image forming apparatus 1 is seen from a front side. FIG. 2 shows a configuration of the image forming apparatus in a normal installation state in which the image forming apparatus is placed on a horizontal installation surface, in which a left-right direction of a paper plane corresponds to a horizontal direction of the apparatus and an up-down direction of the paper plane corresponds to an up-down direction of the apparatus, and a near side of the paper plane corresponds to a front side of the image forming apparatus. During normal use, a user operates the image forming apparatus while facing the front of the image forming apparatus. It should be noted that contents of descriptions related to directions such as left-right and up-down in the following description with reference to drawings other than FIG. 2 are based on FIG. 2.

Paper Feed

A cassette 2 is retractably housed in a lower part of the image forming apparatus 1. A cassette feeding portion 3 is arranged near an end of the cassette 2. Transfer materials (recording materials) such as sheets of paper are respectively stacked and housed in the cassette 2, and the transfer materials are separated into single sheets to be fed to a resist roller 5.

Image Forming Portion

The image forming apparatus 1 includes an image forming portion 6 as image forming means that is constituted by image forming stations 6Y, 6M, 6C, and 6K which correspond to toners (developers) of respective colors of yellow (Y), magenta (M), cyan (C), and black (K), the image forming stations 6Y, 6M, 6C, and 6K being arranged side by side in a single horizontal row. Provided inside the image forming portion 6 are photosensitive drums 7Y, 7M, 7C, and 7K (hereinafter, collectively referred to as a photosensitive drum 7) which are image bearing members and charging apparatuses 8Y, 8M, 8C, and 8K (a charging apparatus 8) which uniformity charge a surface of the photosensitive drum 7. Developing apparatuses 9Y, 9M, 9C, and 9K (a developing apparatus 9) which cause toner to adhere to an electrostatic latent image and which develops the electrostatic latent image as a toner image (a developer image) are also provided inside the image forming portion 6. Furthermore, photosensitive member cleaning blades 10Y, 10M, 10C, and 10K (a photosensitive member cleaning blade 10) which remove residual toner that remains on the photosensitive drum 7 are also provided inside the image forming portion 6. The developing apparatus 9 is provided with developing rollers 11Y, 11M, 11C, and 11K (a developing roller 11) which correspond to the respective colors in a configuration that enables the developing roller 11 to come into contact with and separate from each photosensitive drum 7. A lifespan of the developing roller 11 is extended by causing the developing roller 11 to come into contact with and separate from each photosensitive drum 7 in accordance with an electrostatic latent image or, in other words, in accordance with whether or not the image needs to be developed. In addition, a scanner unit 12 which irradiates a laser beam based on image information and which forms an electrostatic latent image on the photosensitive drum 7 is provided in a lower part of the image forming portion 6. The image forming stations 6Y, 6M, 6C, and 6K are configured so as to be attachable and detachable to and from an apparatus main body of the image forming apparatus 1 as process cartridges. The process cartridge is configured such that the developing apparatus 9 provided with the developing roller 11 and a photosensitive unit provided with the photosensitive drum 7, the charging apparatus 8, and the cleaning blade 10 are respectively or integrally attachable to and detachable from the apparatus main body. In the present embodiment, while the developing apparatus 9 has its own toner housing chamber, a configuration is adopted in which the toner housing chamber is replenished with toner supplied from a toner replenishing cartridge 13 (to be described later). In this case, the apparatus main body of the image forming apparatus 1 refers to componentry with the exception of components that are attachable to and detachable from the apparatus main body 1 such as the process cartridge described above and the toner cartridge to be described later.

Toner Replenishing Cartridge

Toner replenishing cartridges 13Y, 13M, 13C, and 13K (a toner replenishing cartridge 13) for replenishing toner to each image forming station (image forming portion) 6 are attachably and detachably arranged approximately horizontally between the scanner unit 12 and the cassette 2. The inside of the toner replenishing cartridge 13 is filled with replenishing toner that corresponds to each color. Toner transport apparatuses 14Y, 14M, 14C, and 14K (a toner transport apparatus 14) transport, in an upward direction, toner received from the toner replenishing cartridge 13 and supplies the developing apparatus 9 with the toner. The toner transport apparatus 14 is driven by toner transport driving apparatuses 15Y, 15M, 15C, and 15K (a toner transport driving apparatus 15) arranged below the toner transport apparatus 14. Detailed descriptions of the toner replenishing cartridge 13 and the toner transport apparatus 14 will be provided later.

Transfer

An intermediate transfer unit 16 is provided above the developing apparatus 9. The intermediate transfer unit 16 is arranged approximately horizontally with a side opposing each image forming station (image forming portion) 6 facing downward. An intermediate transfer belt 18 that opposes each photosensitive drum 7 is a rotatable endless belt which is stretched between a plurality of tension rollers. Primary transfer rollers 19Y, 19M, 19C, and 19K (a primary transfer roller 19) are arranged as a primary transfer member on an inner surface of the intermediate transfer belt 18. Each primary transfer roller 19 is arranged at a position where primary transfer portions 20Y, 20M, 20C, and 20K (a primary transfer portion 20) are formed with each photosensitive drum 7 via the intermediate transfer belt 18. At each primary transfer portion 20, a toner image is transferred from each photosensitive drum 7 to the intermediate transfer belt 18 by the primary transfer roller 19 to which voltage is applied. In the present embodiment, as the intermediate transfer unit 16, a unit including the intermediate transfer belt 18, the plurality of tension rollers between which the intermediate transfer belt 18 is stretched, and each primary transfer roller 19 is configured so as to be attachable to and detachable from the apparatus main body.

A secondary transfer roller 21 that is a secondary transfer member is in contact with the intermediate transfer belt 18 and forms a secondary transfer portion 17 with an opposing-side roller via the intermediate transfer belt 18. At the secondary transfer portion 17, the toner image having been transferred onto the intermediate transfer belt 18 is secondarily transferred to a transfer material (a recording material) such as a sheet of paper. Toner which is not transferred to the transfer material during secondary transfer and which remains on the intermediate transfer belt 18 is removed by a cleaning unit 22. The toner removed by the cleaning unit 22 is transported to a toner recovery container 24 via a toner transport portion 23 and accumulated in the toner recovery container 24.

Fixing, Paper Discharge

The transfer material to which the toner image has been transferred at the secondary transfer portion 17 is subsequently transported to a fixing apparatus 25 and passes through a nip which is formed by a heating unit 25*a* inside the fixing apparatus 25 and a pressure roller 25*b* that comes into pressure contact with the heating unit 25*a*. The transfer material having passed through the fixing apparatus 25 and to which the toner image has been fixed is transported to a discharge roller pair 27 and discharged to a transfer material stacking portion 32.

Power Supply Apparatus

A low-voltage power supply apparatus 33 which supplies voltage to control portions of various motors, fans, solenoids, and the like provided inside the image forming apparatus 1 is arranged on a rear surface-side of the image forming apparatus 1. In addition, a high-voltage power supply apparatus 34 for applying high voltage to the charging apparatus 8, the developing apparatus 9, the primary transfer roller 19, the secondary transfer roller 21, and the like is arranged in a space between the intermediate transfer belt 18 and the toner recovery container 24.

Embodiments of Present Invention

Figure 3A:
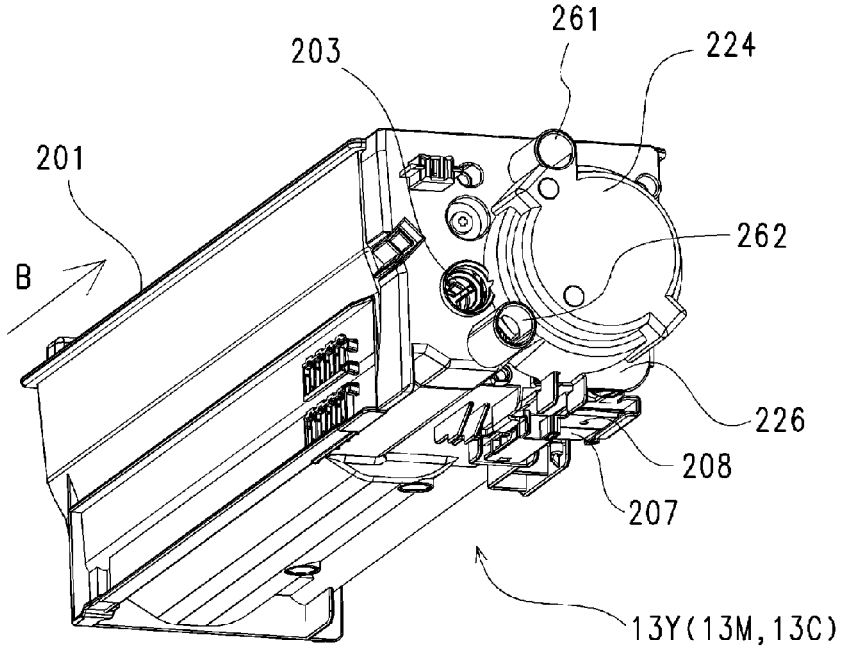
FIGS. 3A and 3B are perspective views of toner replenishing cartridges 13Y to 13C according to the first embodiment.
Figure 3B:
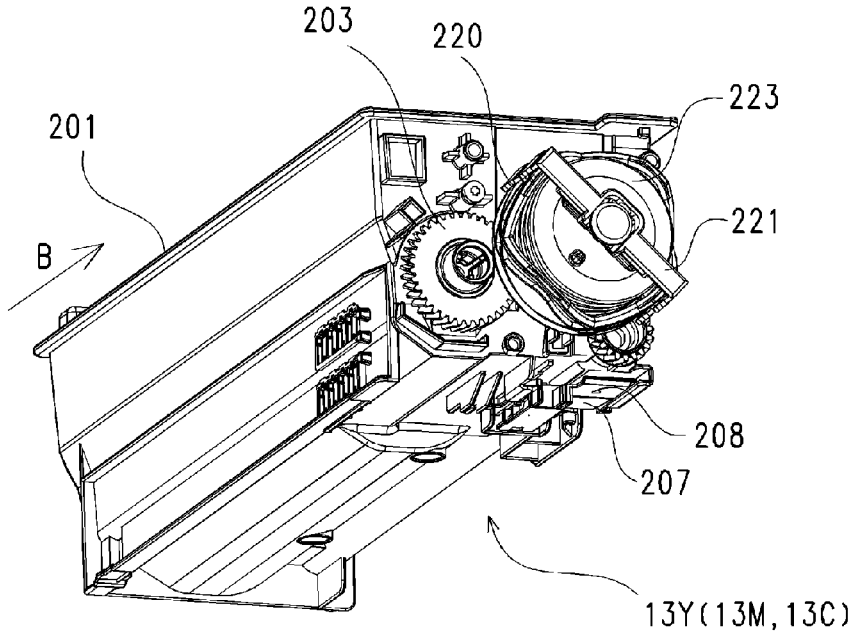
Figure 3C:
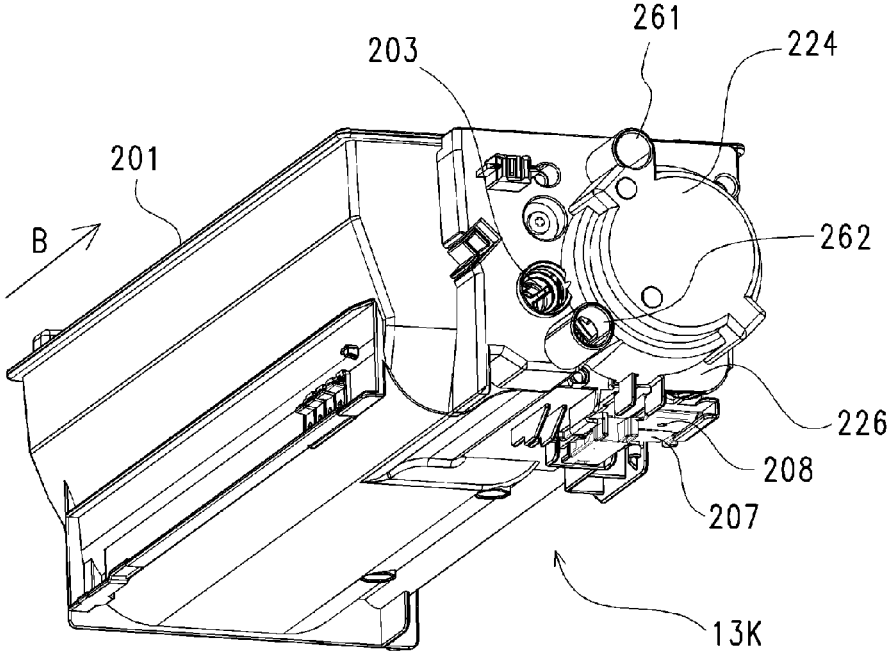
FIGS. 3C and 3D are perspective views of a toner replenishing cartridge 13K according to the first embodiment.
Figure 3D:
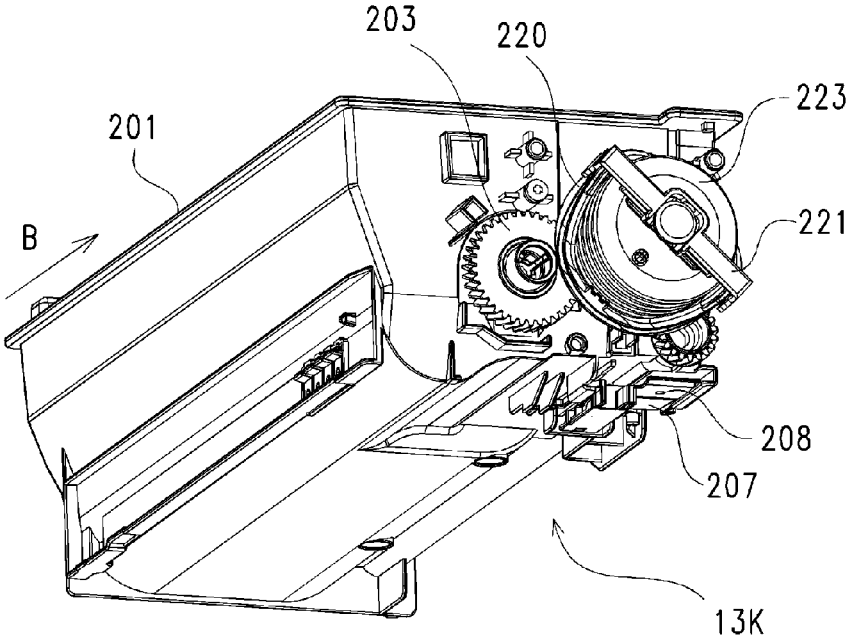
Figure 4A:
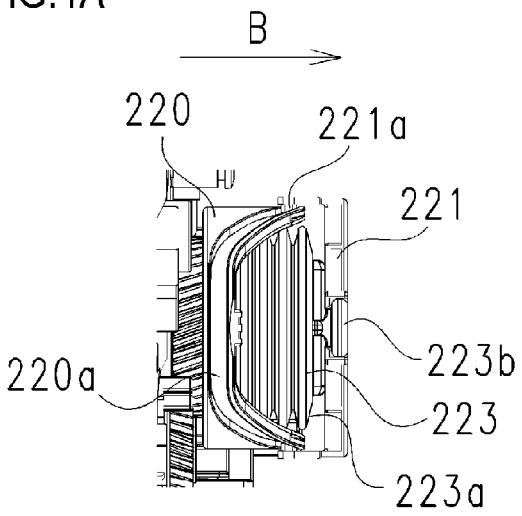
FIGS. 4A to 4C are explanatory diagrams of a cam configuration of the toner replenishing cartridge 13 according to the first embodiment.
Figure 4B:
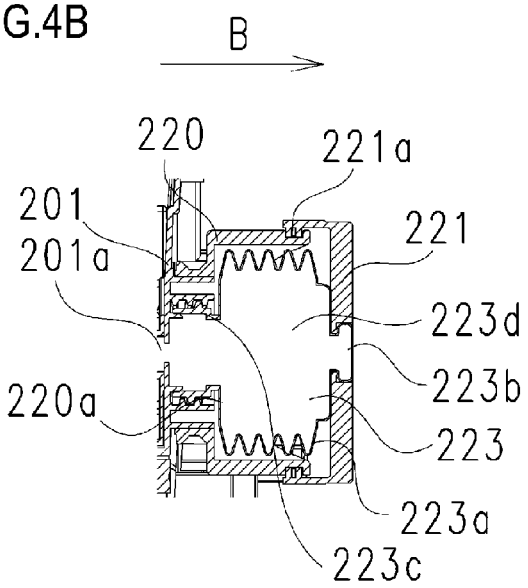
Figure 4C:
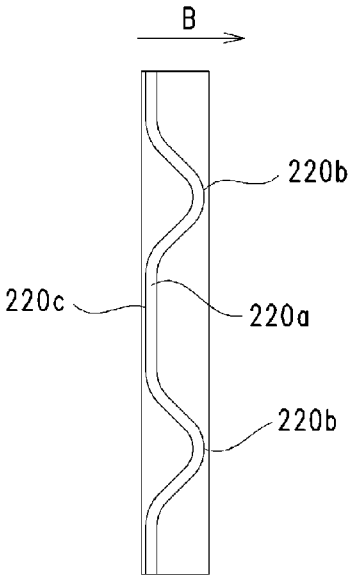

The toner replenishing cartridge 13 that is a characteristic component of the present embodiment will now be described with reference to FIGS. 3A, 3B, 3C, 3D, and FIGS. 4A to 4C. FIGS. 3A, 3B, 3C, and 3D are perspective views of the toner replenishing cartridge 13 according to the present embodiment as seen from a downstream side in a mounting direction (a direction of an arrow B). FIG. 3A is a perspective view of the toner replenishing cartridges 13Y to 13C, and FIG. 3B is a perspective view in a state where a side cover 224 has been removed in FIG. 3A. FIG. 3C is a perspective view of the toner replenishing cartridges 13K, and FIG. 3D is a perspective view in a state where the side cover 224 has been removed in FIG. 3C. FIGS. 4A to 4C are explanatory diagrams showing a configuration of a cam according to the present embodiment. FIG. 4A is an explanatory diagram representing configurations of a cam gear 220, a linking mechanism 221, and a pump 223, and FIG. 4B is a sectional view thereof. FIG. 4C is an expanded view of a cam groove 220*a* of the cam gear 220.

As shown in FIGS. 3A, 3B, and 3C, 3D, the toner replenishing cartridge 13 has, as a developer container, a replenishing frame body 201 with an approximately rectangular parallelepiped shape in a longitudinal direction, in which toner is housed inside the replenishing frame body 201. A drive coupling 203, the cam gear 220, the linking mechanism 221, and a pump 223 are arranged on the downstream side in the mounting direction (the direction of the arrow B) of the toner replenishing cartridge 13 and are covered by the side cover 224. In the present embodiment, the toner replenishing cartridge 13 is mounted by being inserted toward a far side of the apparatus from a mounting port that opens to the front of the apparatus main body. A housing portion of the apparatus main body for housing the toner replenishing cartridge 13 is provided with a guide structure such as a guide rail for guiding the toner replenishing cartridge 13 along a given mounting direction from an unmounted position to a given mounting-completed position. In the present embodiment, the mounting direction of the toner replenishing cartridge 13 with respect to the apparatus main body is a horizontal direction from a near side toward a far side of the image forming apparatus. In addition, a supply shutter 207 provided with a supply port 208 is arranged on a lower surface side of the toner replenishing cartridge 13 (a lower side of an attitude of the toner replenishing cartridge 13 when being inserted into or withdrawn from the image forming apparatus) so as to be relatively movable with respect to the replenishing frame body 201.

The drive coupling 203 is arranged so as to transmit drive to the cam gear 220 and a screw (not illustrated) inside the replenishing frame body 201. When the toner replenishing cartridge 13 is mounted inside the image forming apparatus 1, drive is transmitted as the drive coupling 203 engages with a main body-side drive coupling (not illustrated). As shown in FIGS. 4A to 4C, the cam gear 220 is provided with the cam groove 220*a* and a cam projected portion 221*a* of the linking mechanism 221 is engaged with the cam groove 220*a*. The linking mechanism 221 is supported by the side cover 224 so as to be movable in the mounting direction of the toner replenishing cartridge 13 (the direction of the arrow B). The cam groove 220*a* is provided with a crest portion 220*b* that is inclined toward a downstream side in the mounting direction (the direction of the arrow B) and a root portion 220*c* that is inclined toward an upstream side in the mounting direction (the direction of the arrow B). As the cam gear 220 rotates, the cam projected portion 221*a* alternately passes the crest portion 220*b* and the root portion 220*c* of the cam groove 220*a*, thereby causing the linking mechanism 221 to reciprocate in the mounting direction (the direction of the arrow B).

The linking mechanism 221 is coupled to a coupling portion 223*b* of the pump 223. The pump 223 is provided with a connecting portion 223*c* on an opposite side relative to the coupling portion 223*b* in the mounting direction (the direction of the arrow B), and the connecting portion 223*c* is fixed to the replenishing frame body 201. The pump 223 is internally provided with an internal space 223*d* that communicates via the connecting portion 223*c* with a toner housing chamber 201*a* which is an internal space of the replenishing frame body 201 and in which toner is to be housed. In this case, while the coupling portion 223*b* of the pump 223 reciprocates in conjunction with the linking mechanism 221, since the connecting portion 223*c* is fixed by the replenishing frame body 201, the pump 223 performs an expanding and contracting motion at a bellows portion 223*a*. Due to the expanding and contracting motion, a capacity of the internal space 223*d* of the pump 223 fluctuates and internal pressure of the toner housing chamber 201*a* that communicates with the internal space 223*d* also fluctuates. As a result, toner is discharged from the supply port 208 to be described later.

Configuration of Supply Shutter 207

Figure 5A:
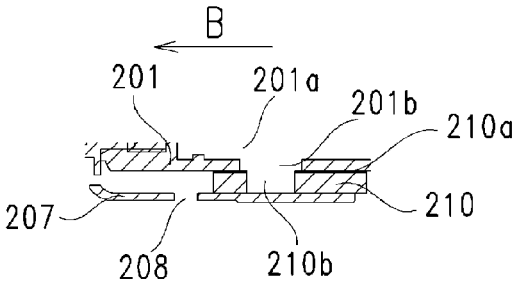
FIGS. 5A, 5B, 5C and 5D are explanatory diagrams of a configuration near a supply port of the toner replenishing cartridge 13 according to the first embodiment.
Figure 5B:
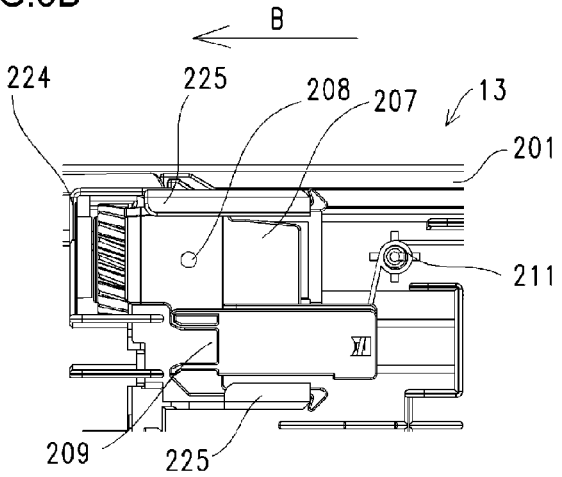
Figure 5C:
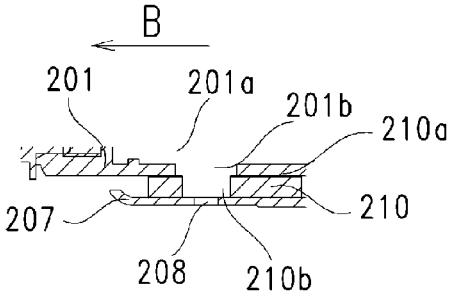
Figure 5D:
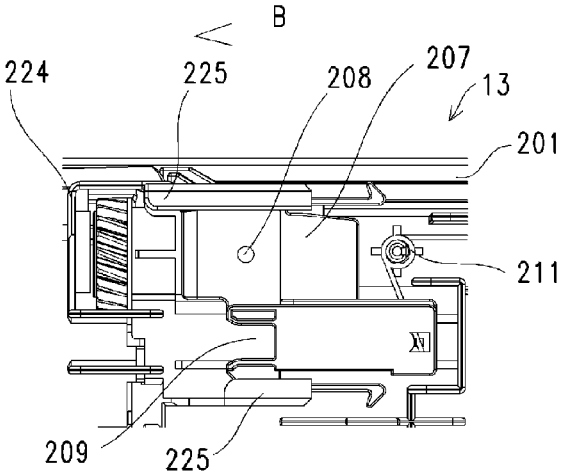
Figure 6A:
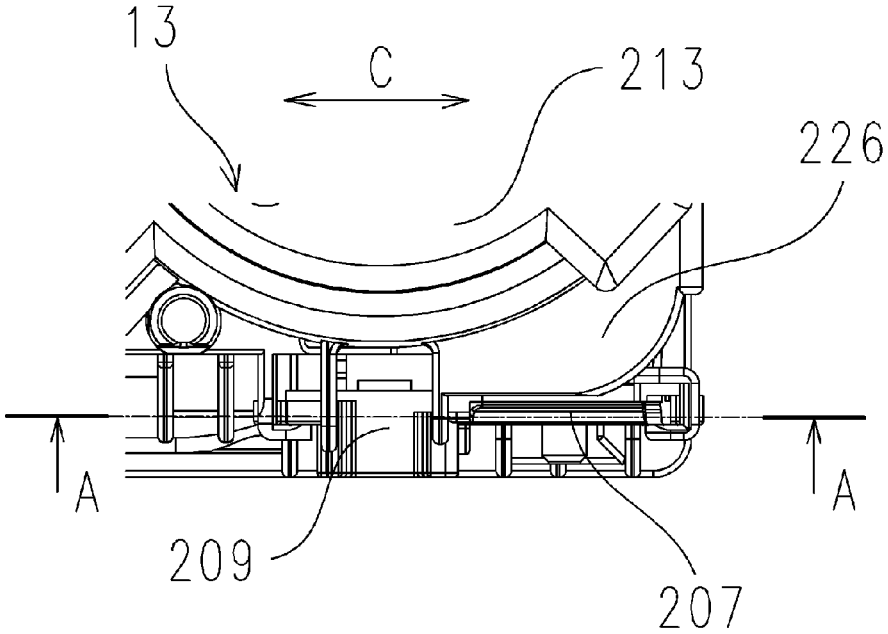
FIGS. 6A and 6B are explanatory diagrams of a shutter configuration of the toner replenishing cartridge 13 according to the first embodiment.
Figure 6B:
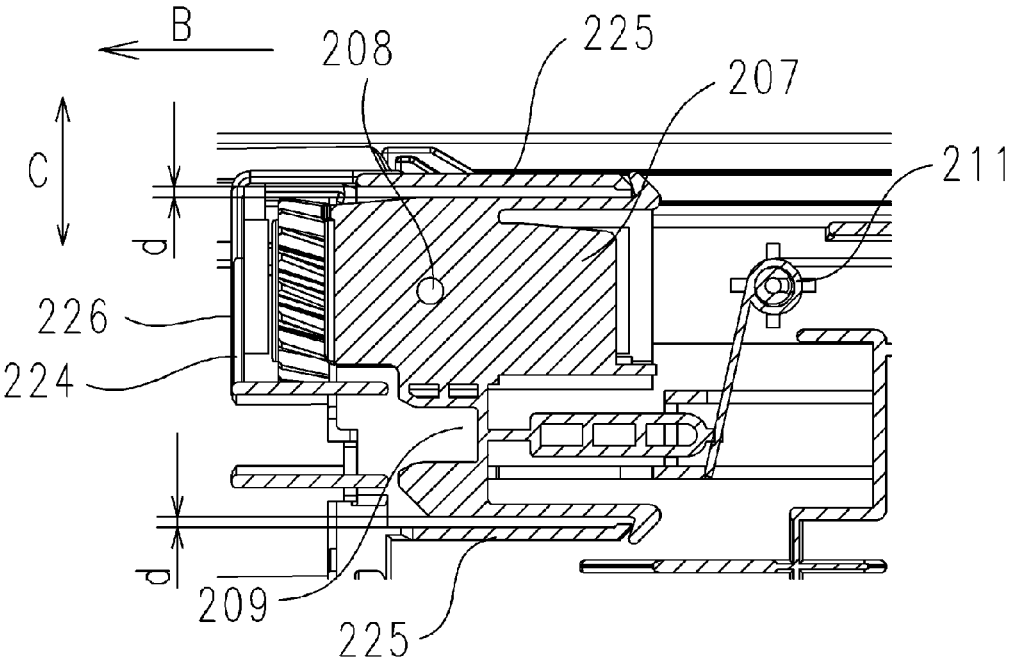

A configuration of the supply shutter 207 will be described with reference to FIGS. 5A to 5D, 6A and 6B. FIGS. 5A to 5D, are explanatory diagrams of a portion near a supply port of the toner replenishing cartridge 13 according to the present embodiment. FIG. 5A is a partial sectional view in a closed state (an unmounted state) of the supply shutter 207, and FIG. 5B is an explanatory diagram of a portion near the supply port 208 in FIG. 5A. FIG. 5C is a partial sectional view in an opened state (a mounted state) of the supply shutter 207 in the supply port 208 of the toner replenishing cartridge 13, and FIG. 5D is an explanatory diagram of a portion near the supply port 208 in FIG. 5C. FIGS. 6A and 6B are explanatory diagrams of the supply shutter 207 of the toner replenishing cartridge 13 according to the present embodiment. FIG. 6A is a side view of the supply shutter 207 as seen from the downstream side in the mounting direction (the direction of the arrow B), and FIG. 6B is a sectional view taken along an A-A section in FIG. 6A.

As shown in FIGS. 5A to 5D, a replenishing frame body opening 201*b* as a supply port, a supply port seal 210, and the supply shutter 207 provided with the supply port 208 as a first communication hole are arranged on a lower surface of the replenishing frame body 201 on the downstream side in the mounting direction (the direction of the arrow B). The replenishing frame body opening 201*b* is provided on the replenishing frame body 201 and communicates with the toner housing chamber 201*a*. In addition, the supply port seal 210 as a first elastic member is arranged in a vicinity of the replenishing frame body opening 201*b*. The supply port seal 210 is provided with a communication port 210*b* as a second communication hole. The supply port seal 210 is fixed in close contact to the replenishing frame body 201 by a double-sided tape 210*a* so that the communication port 210*b* as the second communication hole connects the replenishing frame body opening 201*b* as the supply port with the supply port 208 as the first communication hole with each other. It should be noted that, in the present embodiment, the communication port 210*b* is formed as a round hole with a smaller diameter than the replenishing frame body opening 201*b*. In addition, the supply shutter 207 is held so as to be slidable (relatively movable) with respect to the replenishing frame body 201 so as to open and close the replenishing frame body opening 201*b*. The supply shutter 207 is assembled to the replenishing frame body 201 at a position of close contact with the supply port seal 210 and is configured so as to be slidable with respect to the supply port seal 210. Furthermore, due to a supply shutter spring 211 as a biasing member, the supply shutter 207 is pressed toward the downstream side in the mounting direction (the direction of the arrow B) and, normally (when not mounted), closes the communication port 210*b* (a closed state).

The supply shutter 207 is provided with a restricted portion 209 for engaging with the toner transport apparatus 14 as a developer receiving portion that is provided on the apparatus main body. In addition, a supply shutter rail 225 as a guiding portion is provided at two locations in the replenishing frame body 201 in order to slidably hold the supply shutter 207. As shown in FIGS. 6A and 6B, a gap d is provided between the supply shutter rail 225 and the supply shutter 207 in a left-right direction (a horizontal direction that is perpendicular to the mounting direction). In other words, the supply shutter 207 is held by the supply shutter rail 225 (in other words, the replenishing frame body 201) with a play of d in the left-right direction.

In addition, the toner replenishing cartridge 13 is provided with a shutter contact portion 226 which comes into contact with and opens a receiving portion shutter 307 (refer to FIGS. 7A and 7B) as a second shutter member to be described later. Details of operations when attaching or detaching the toner replenishing cartridge 13 will be described later.

Details of Toner Transport Apparatus 14

Figure 7A:
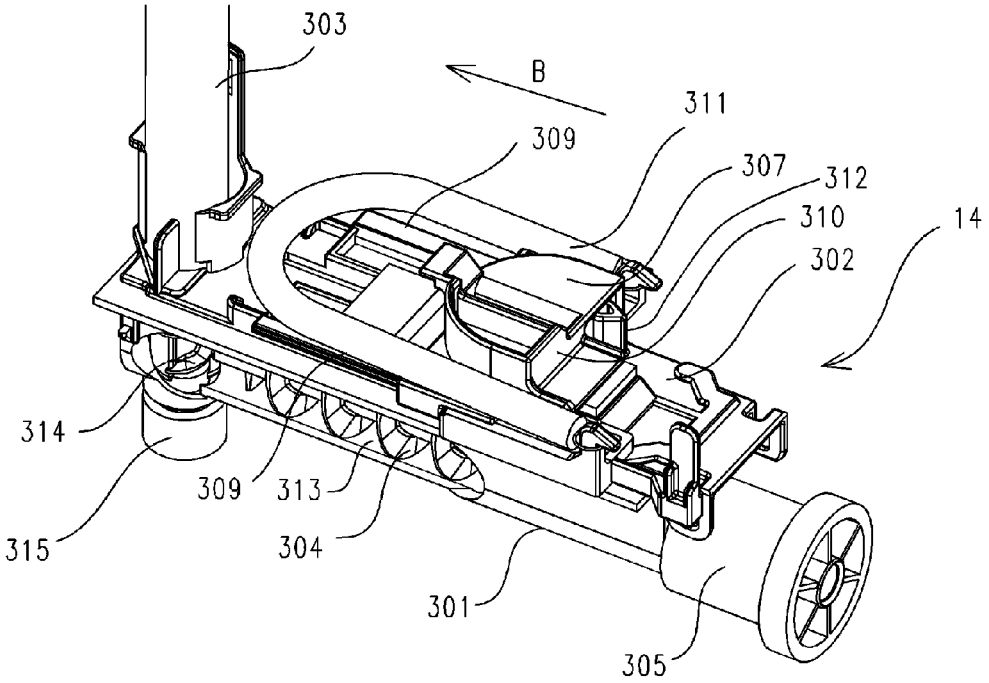
FIGS. 7A and 7B are explanatory diagrams of a configuration of a toner transport apparatus 14 according to the first embodiment.
Figure 7B:
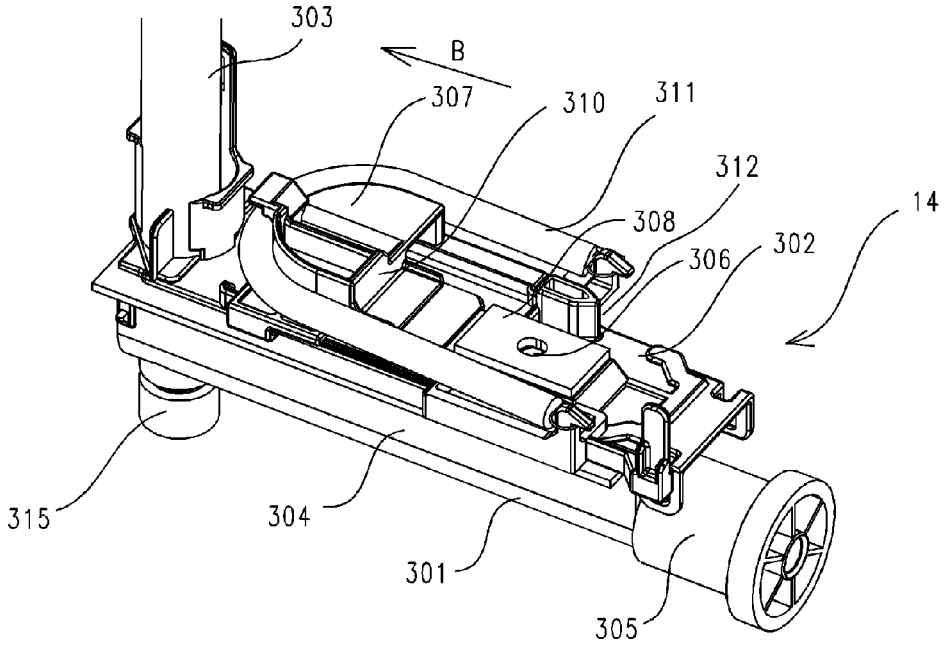
Figure 8:
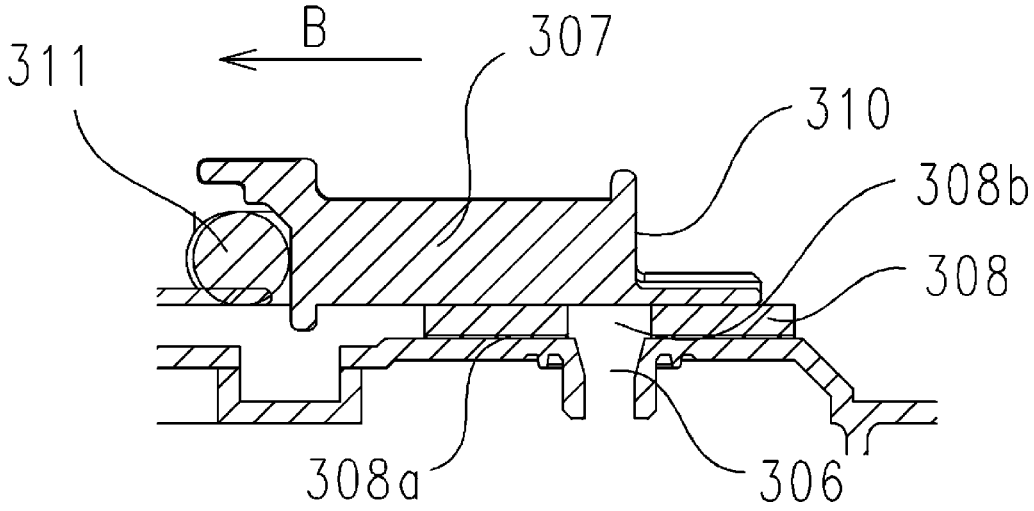
FIG. 8 is an explanatory diagram of a configuration of the toner transport apparatus 14 according to the first embodiment.

Details of the toner transport apparatus 14 will be described with reference to FIGS. 7A, 7B, and 8. FIGS. 7A, 7B, and 8 are explanatory diagrams representing a configuration of the toner transport apparatus 14 according to the present embodiment. FIG. 7A is a perspective view of the toner transport apparatus 14 as seen from the upstream side in the mounting direction (the direction of the arrow B) when the receiving portion shutter 307 is in a closed state (an unmounted state of the toner replenishing cartridge 13). FIG. 7B is a perspective view of the toner transport apparatus 14 as seen from the upstream side in the mounting direction (the direction of the arrow B) when the receiving portion shutter 307 is in an opened state (a mounted state of the toner replenishing cartridge 13). FIG. 8 is a partial sectional view of the toner transport apparatus 14 in FIG. 7A.

As shown in FIG. 7A, the toner transport apparatus 14 constitutes a toner transport path 313 for transporting toner with a toner receiving container 301, a cover 302, and a longitudinal transport pipe 303. In FIGS. 7A and 7B, for the sake of brevity, the inside of the toner transport path 313 is made visible by cutting away a portion thereof. A toner horizontal transport member 304 and a toner upward transport member 314 are arranged inside the toner transport path 313 in order to transport the toner inside the toner transport path 313. The toner horizontal transport member 304 and the toner upward transport member 314 are resin screws having a spiral shape and are housed so as to be rotatable inside the toner transport path 313. The toner horizontal transport member 304 is rotated by a driving force transmitted by a horizontal transport member drive gear 305 that engages from outside of the toner receiving container 301. In a similar manner, the toner upward transport member 314 is rotated by a driving force transmitted by an upward transport member drive gear 315 that engages from outside of the toner receiving container 301. It should be noted that effects produced by the present invention remain unchanged even if driving connecting means of the transport members adopt modes that differ from those according to the present embodiment.

The cover 302 has a toner receiving port 306 that accepts toner replenished from the toner replenishing cartridge 13. In addition, a receiving portion seal 308 as a second elastic member is arranged in a vicinity of the toner receiving port 306. The receiving portion seal 308 is provided with a communication port 308*b* as a third communication hole and is fixed in close contact to the cover 302 by a double-sided tape 308*a* so that the communication port 308*b* communicates with the toner receiving port 306. It should be noted that, in the present embodiment, the communication port 308*b* is formed as an oval hole with a larger diameter than the toner receiving port 306. In addition, the receiving portion shutter 307 is slidably held by a receiving portion shutter rail 309 as a guide portion provided on the cover 302 at a position where the receiving portion shutter 307 comes into close contact with the receiving portion seal 308. Furthermore, due to a receiving portion shutter spring 311 as a biasing member, the receiving portion shutter 307 is pressed toward the upstream side in the mounting direction (the direction of the arrow B) and, normally (when the toner replenishing cartridge 13 is not mounted), closes the communication port 308*b* or, in other words, the toner receiving port 306.

The toner replenishing cartridge 13 comes into contact with the receiving portion shutter 307 and the receiving portion shutter 307 is provided with a container contact portion 310 for opening the receiving portion shutter 307. In addition, the cover 302 is provided with a restricting portion 312 for engaging with the restricted portion 209 of the supply shutter 207 provided on the toner replenishing cartridge 13. Details of operations when attaching or detaching the toner replenishing cartridge 13 will be described later.

Toner supplied from the toner replenishing cartridge 13 is supplied from the toner receiving port 306 to the inside of the toner receiving container 301 and transported to the developing apparatus 9 by the respective toner transport members.

Mounting Operation of Toner Replenishing Cartridge 13

Figure 1A:
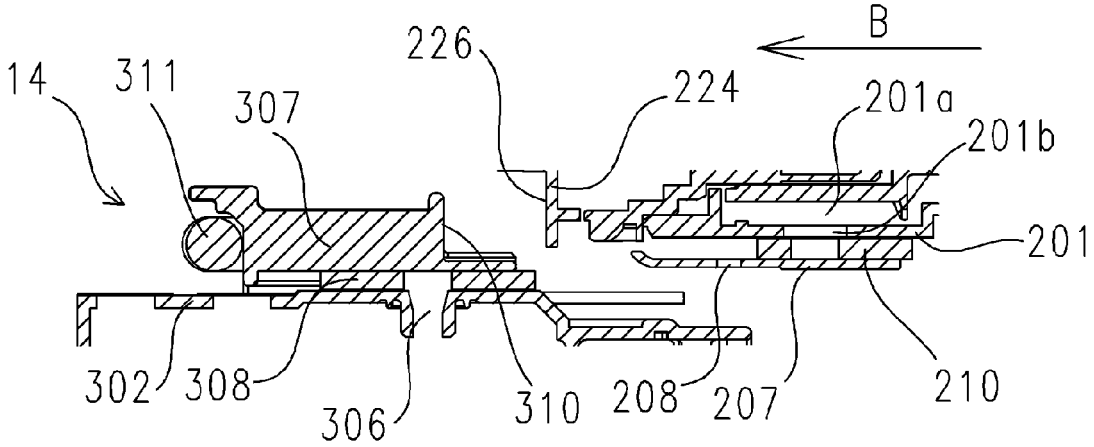
FIGS. 1A and 1B are explanatory diagrams showing how a toner replenishing cartridge 13 according to a first embodiment is mounted.
Figure 1B:
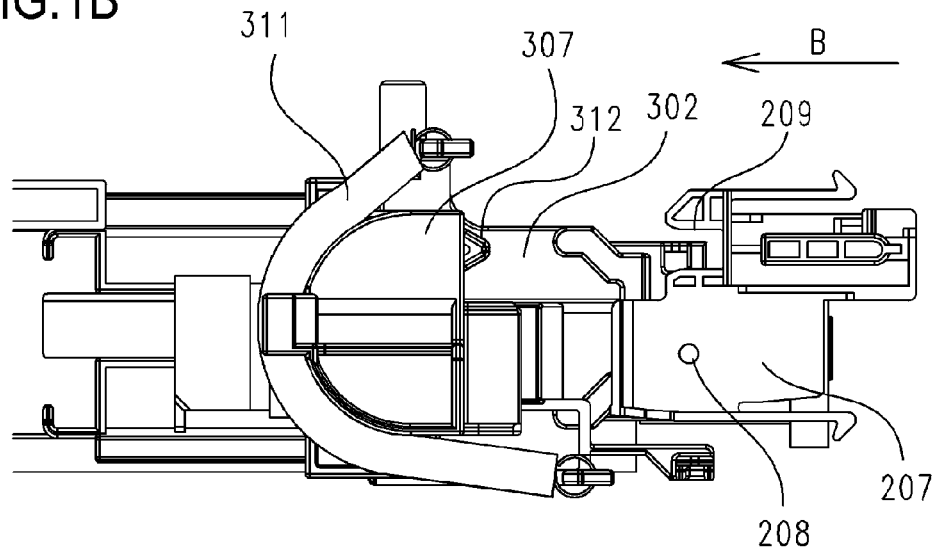
Figure 1C:
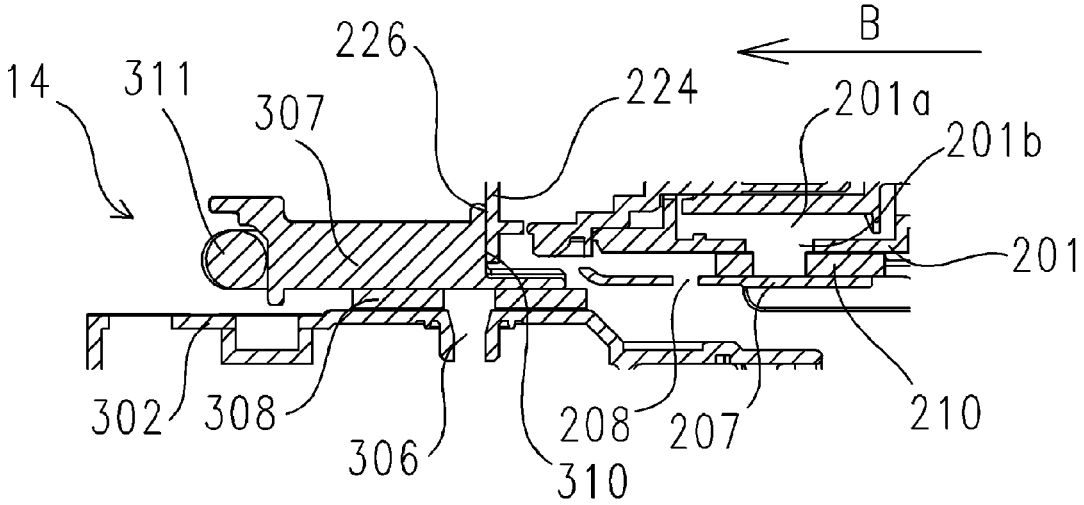
FIGS. 1C and 1D are explanatory diagrams showing how the toner replenishing cartridge 13 according to the first embodiment is mounted.
Figure 1D:
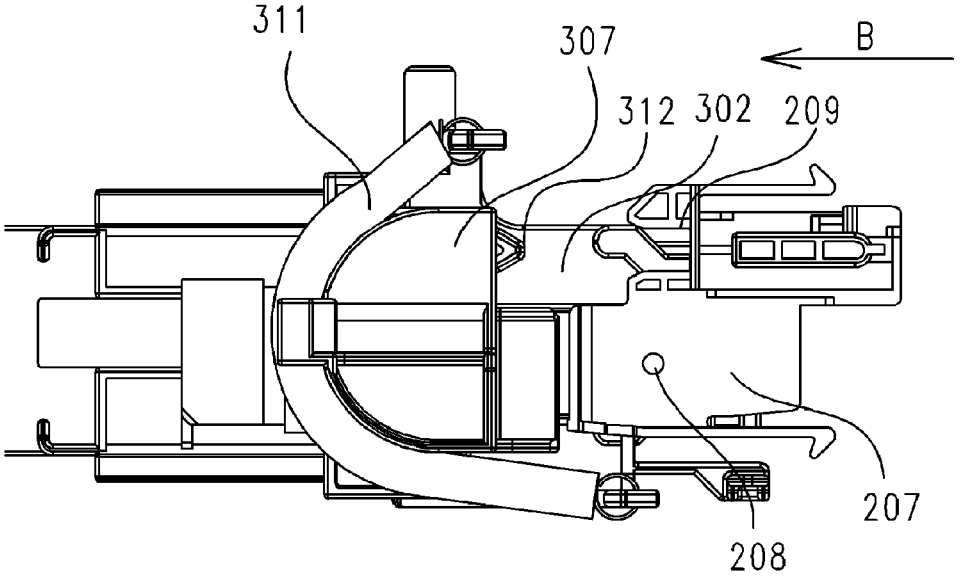
Figure 1E:
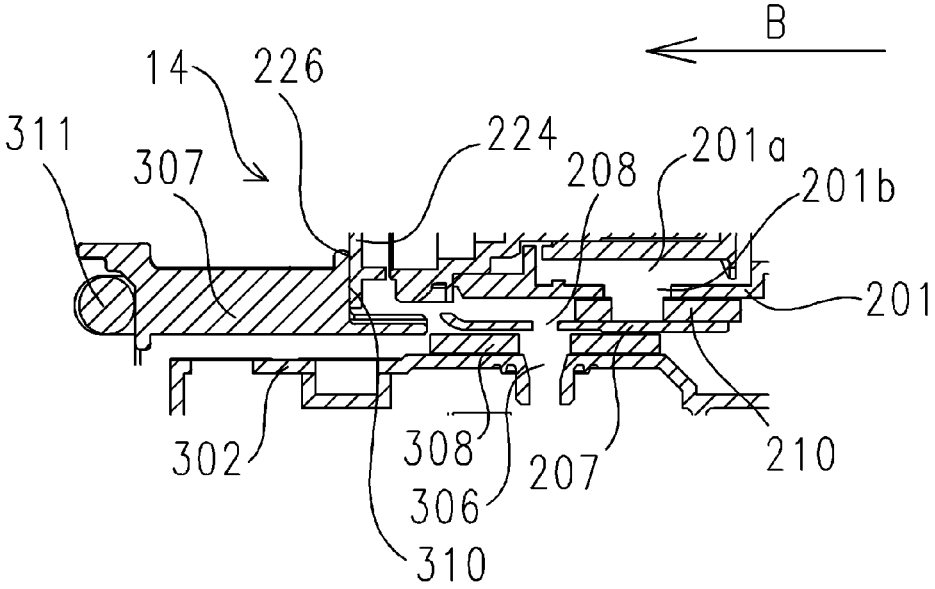
FIGS. 1E and 1F are explanatory diagrams showing how the toner replenishing cartridge 13 according to the first embodiment is mounted.
Figure 1F:
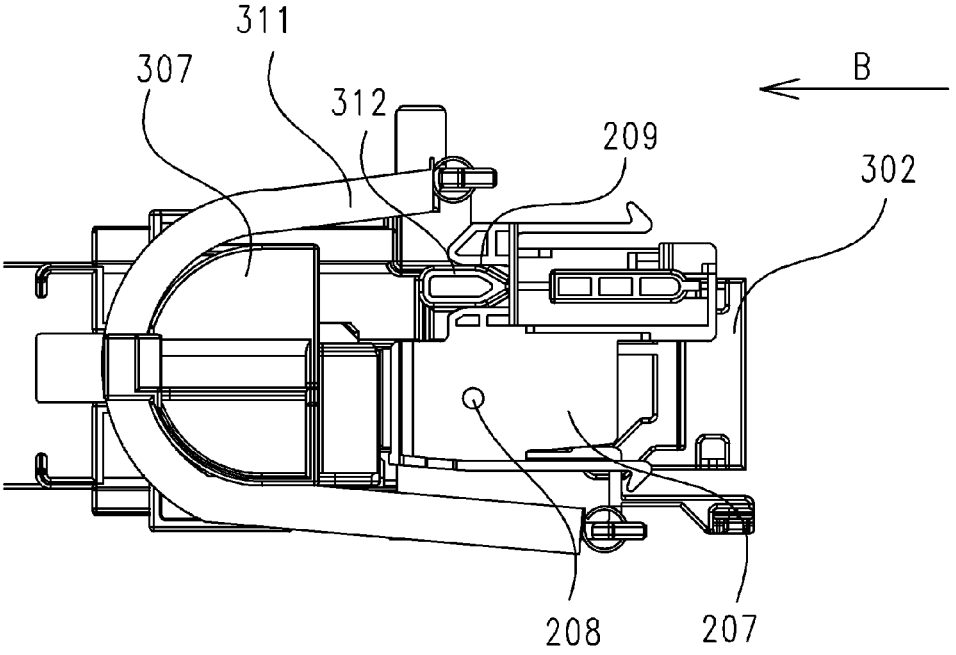
Figure 1G:
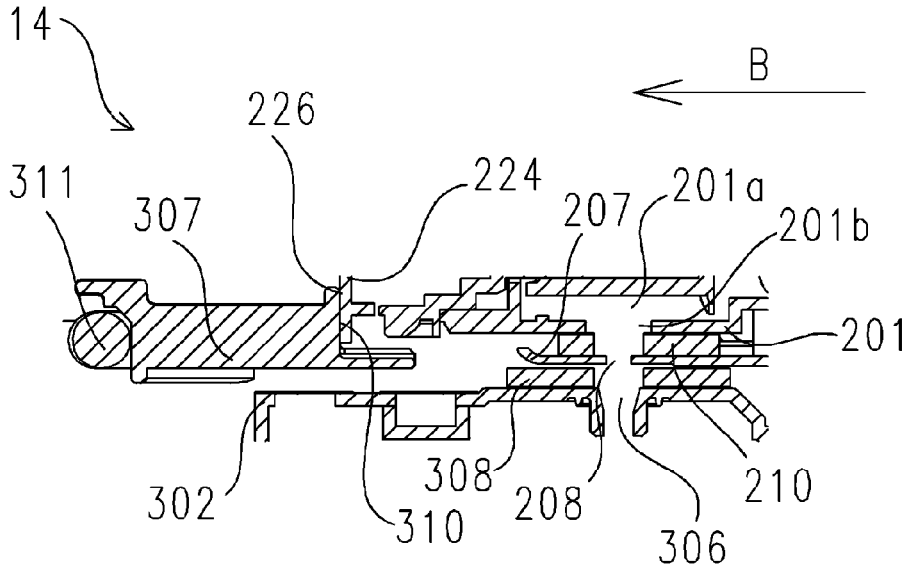
FIGS. 1G and 1H are explanatory diagrams showing how the toner replenishing cartridge 13 according to the first embodiment is mounted.
Figure 1H:
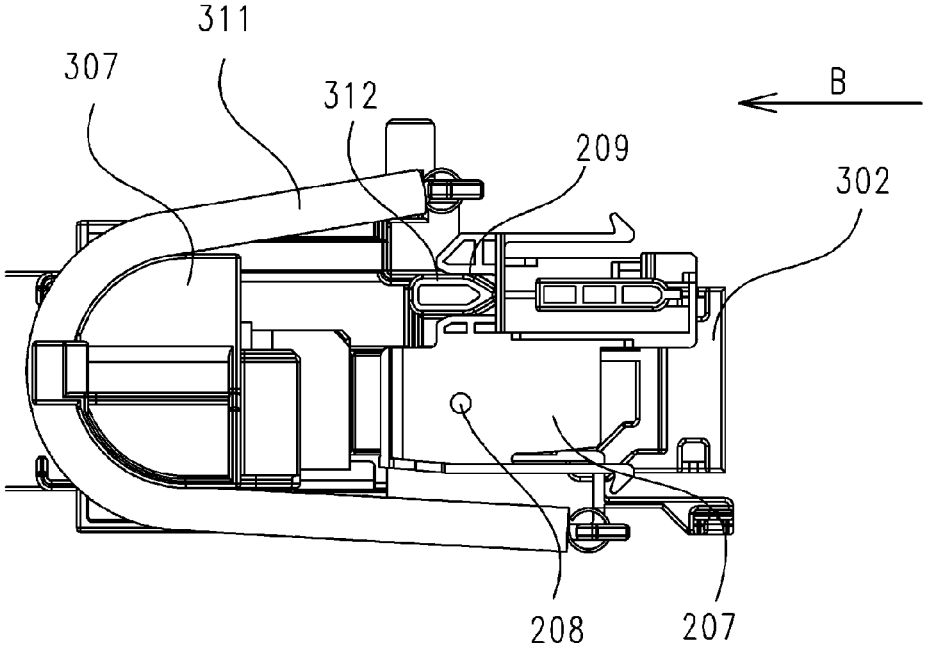
Figure 9A:
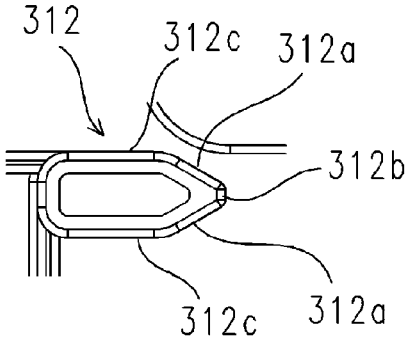
FIGS. 9A to 9C are detailed diagrams showing a configuration of a restricting portion 312 and a restricted portion 209 according to the first embodiment.
Figure 9B:
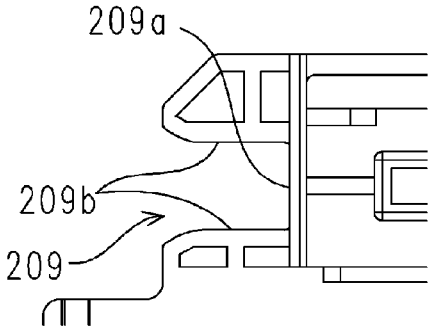
Figure 9C:
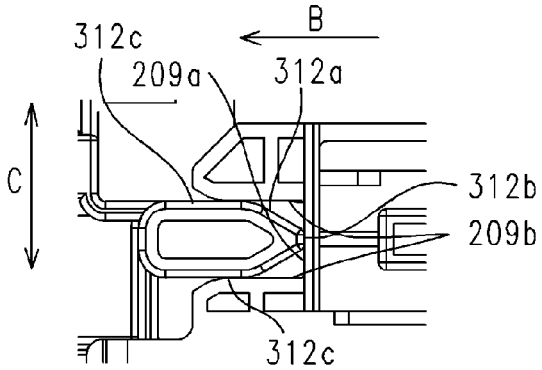

Next, a mounting operation of the toner replenishing cartridge 13 will be described with reference to FIGS. 1A to 1H, and 6A to 9C. FIGS. 1A to 1H are explanatory diagrams of a portion near the supply port 208 and a portion near the toner receiving port 306 showing a process by which the toner replenishing cartridge 13 according to the present embodiment is mounted to the image forming apparatus 1. FIG. 1A is a sectional view showing an unmounted state of the toner replenishing cartridge 13, and FIG. 1B is an explanatory diagram showing states of the toner transport apparatus 14 and the supply shutter 207 in FIG. 1A. In addition, FIG. 1C and FIG. 1D are a sectional view and an explanatory diagram showing a state where the receiving portion shutter 307 starts to open. FIG. 1E and FIG. 1F are a sectional view and an explanatory diagram showing a state where the toner receiving port 306 and the supply port 208 start to communicate with each other. FIG. 1G and FIG. 1H are a sectional view and an explanatory diagram showing a mounting-completed position in a state where the toner receiving port 306, the supply port 208, and the replenishing frame body opening 201*b* communicate with each other. FIGS. 9A to 9C are detailed diagrams of the restricting portion 312 and the restricted portion 209 according to the present embodiment. FIG. 9A is a detailed diagram of the restricting portion 312, FIG. 9B is a detailed diagram of the restricted portion 209, and FIG. 9C is a detailed diagram of the restricting portion 312 and the restricted portion 209 when being engaged with each other.

When the toner replenishing cartridge 13 has not been mounted, as shown in FIGS. 1A and 1B, the receiving portion shutter 307 is at a position where the receiving portion shutter 307 blocks the toner receiving port 306. During mounting, when the toner replenishing cartridge 13 reaches a given position, as shown in FIGS. 1C and 1D, the container contact portion 310 of the receiving portion shutter 307 and the shutter contact portion 226 of the toner replenishing cartridge 13 first come into contact with each other and the receiving portion shutter 307 starts to move in the direction of the arrow B. As the toner replenishing cartridge 13 further moves in the direction of the arrow B, as shown in FIGS. 1E and 1F, the receiving portion shutter 307 opens, the receiving portion seal 308 and the toner receiving port 306 are opened and, at the same time, the supply port 208 of the toner replenishing cartridge 13 and the toner receiving port 306 communicate with each other. At the same time, the restricting portion 312 provided on the cover 302 and the restricted portion 209 provided on the receiving portion shutter 307 complete their engagement. It should be noted that, at this point, the supply port 208 and the replenishing frame body opening 201*b* are not communicated with each other. Finally, as shown in FIGS. 1G and 1H, when the toner replenishing cartridge 13 reaches a mounting-completed position (a position during normal use), the supply port 208 and the replenishing frame body opening 201*b* communicate with each other (change to an open state). Accordingly, the replenishing frame body opening 201*b* becomes communicated with the toner receiving port 306 through the supply port 208 and toner can be delivered from the toner replenishing cartridge 13 to the toner transport apparatus 14. In the mounting process, as described earlier, the toner receiving port 306 and the supply port 208 are first communicated with each other and, subsequently, the supply port 208 and the replenishing frame body opening 201*b* communicate with each other. This is done in order to prevent droppage of toner from the supply port and, accordingly, contamination due to droppage of toner inside the image forming apparatus 1 can be reduced.

As shown in FIGS. 1E, 1F, 1G and 1H, a position of the restricted portion 209 of the supply shutter 207 is determined by the restricting portion 312 provided on the cover 302.

As shown in FIG. 9A, in the present embodiment, the restricting portion 312 is formed of an inclined surface 312*a*, a tip portion 312*b*, and a parallel surface 312*c*. It should be noted that the shape of the restricting portion is not limited to that according to the present embodiment and may be any shape such as a cylindrical shape as long as a function as a restricting portion is fulfilled. In addition, as shown in FIG. 9B, the restricted portion 209 is provided with an abutting surface 209*a* and a parallel surface 209*b*. It should be noted that the shape of the restricted portion 209 is not limited to that according to the present embodiment and may be any shape such as an oval shape as long as a function as a restricted portion is fulfilled.

Specifically, the restricting portion 312 has a convex shape configuration with a side to be inserted into the restricted portion 209 being approximately tapered and, on the other hand, the restricted portion 209 has a concave shape configuration with a side into which the restricting portion 312 is to be inserted being opened wide. According to these configurations, even if relative positions of the restricting portion 312 and the restricted portion 209 slightly deviate in a direction of an arrow C due to the play between the supply shutter 207 and the replenishing frame body 201*b* (the supply shutter rail 225), the positional deviation can be absorbed and an engaged state can be formed. It should be noted that a direction of relative movement between the supply shutter 207 and the apparatus main body that is restricted by the restricting portion 312 and the restricted portion 209 is not limited to the three directions described above. In other words, a configuration may be adopted in which the relative movement is restricted in four or more directions including the direction having the play between the supply shutter 207 and the replenishing frame body 201*b*.

Alternatively, shapes of the restricting portion and the restricted portion described above may be interchanged or the restricting portion and the restricted portion may be provided in plurality. In addition, the configurations of the restricting portion and the restricted portion described above are not limited to the configurations described above and various configurations may be adopted as long as functions as the restricting portion and the restricted portion are fulfilled.

As shown in FIG. 9C, when the restricting portion 312 and the restricted portion 209 engage with each other, a biasing force of the supply shutter spring 211 causes the tip portion 312*b* of the restricting portion 312 to abut against the abutting surface 209*a* of the restricted portion 209. In addition, at this point, the parallel surface 209*b* of the restricted portion 209 engages with respect to the parallel surface 312*c* of the restricting portion 312 and the supply shutter 207 is restricted in the direction of the arrow C (the direction having play). As a result, the supply shutter 207 is positioned with respect to the cover 302 in the mounting direction (the direction of the arrow B) and the direction of the arrow C (two directions). In other words, a relative movement of the supply shutter 207 is restricted with respect to the apparatus main body in one orientation (the direction of the arrow B) in the mounting direction and in one orientation (one way of the two-way arrow C) and the other orientation (the other way of the two-way arrow C) in the direction that is perpendicular to the mounting direction. In addition, since the supply shutter 207 is placed in a state where the supply shutter 207 is sandwiched between and comes into pressure contact with two elastic members, namely, the supply port seal 210 and the receiving portion seal 308, the supply shutter 207 is also positioned with respect to the apparatus main body in directions that are perpendicular to the mounting direction (the direction of the arrow B) and the direction having play (the direction of the arrow C).

At this point, since the position of the supply shutter 207 is determined with respect to the cover 302, the supply shutter 207 does not come into contact with the shutter rail 225 (refer to FIGS. 5A to 5D) in the direction of the arrow C. In other words, the supply shutter 207 is positioned with respect to the apparatus main body by the restricting portion 312 of the cover 302 and, meanwhile, the replenishing frame body 201 is also positioned with respect to the apparatus main body by positioning means (not illustrated) provided on the apparatus main body at the mounting-completed position. Specifically, the replenishing frame body 201 is also positioned with respect to the apparatus main body as each of two positioning depressed portions (holes) 261 and 262 which are provided on the side cover 224 and which are depressed in an opposite direction to the mounting direction is fitted with a positioning boss (not illustrated) which is provided on the apparatus main body and which is projected in the opposite direction to the mounting direction. Relative positions of the supply shutter 207 and the replenishing frame body 201 in this positioned state are set so as to create a state where, in the play direction, the supply shutter 207 and the shutter rail 225 do not come into contact with each other (a gap corresponding to the play is provided).

As described above, by restricting the position of the supply shutter 207 of the toner replenishing cartridge 13 with respect to the cover 302 provided with the toner receiving port 306, even when the relative positions of the toner replenishing cartridge 13 and the supply shutter 207 deviate, relative position accuracy of the toner supply port 208 and the toner receiving port 306 does not change. Therefore, a pore diameter of the toner receiving port 306 can be reduced and toner contamination when attaching and detaching the toner replenishing cartridge 13 can be reduced.

In addition, a pore diameter of the communication port 308*b* that connects the toner receiving port 306 with the supply port 208 is larger than pore diameters of the toner receiving port 306 and the supply port 208. Furthermore, pore diameters of the replenishing frame body opening 201*b* and the communication port 210*b* which connect the supply port 208 with the toner housing chamber 201*a* are larger than the pore diameter of the supply port 208. According to these configurations, regardless of a size of the play between the supply shutter 207 and the replenishing frame body 201, the pore diameters of the toner receiving port 306 and the supply port 208 can be reduced while maintaining the communication between the toner receiving port 306 and the replenishing frame body opening 201*b* via the various communication holes.

Second Embodiment

Figure 10:
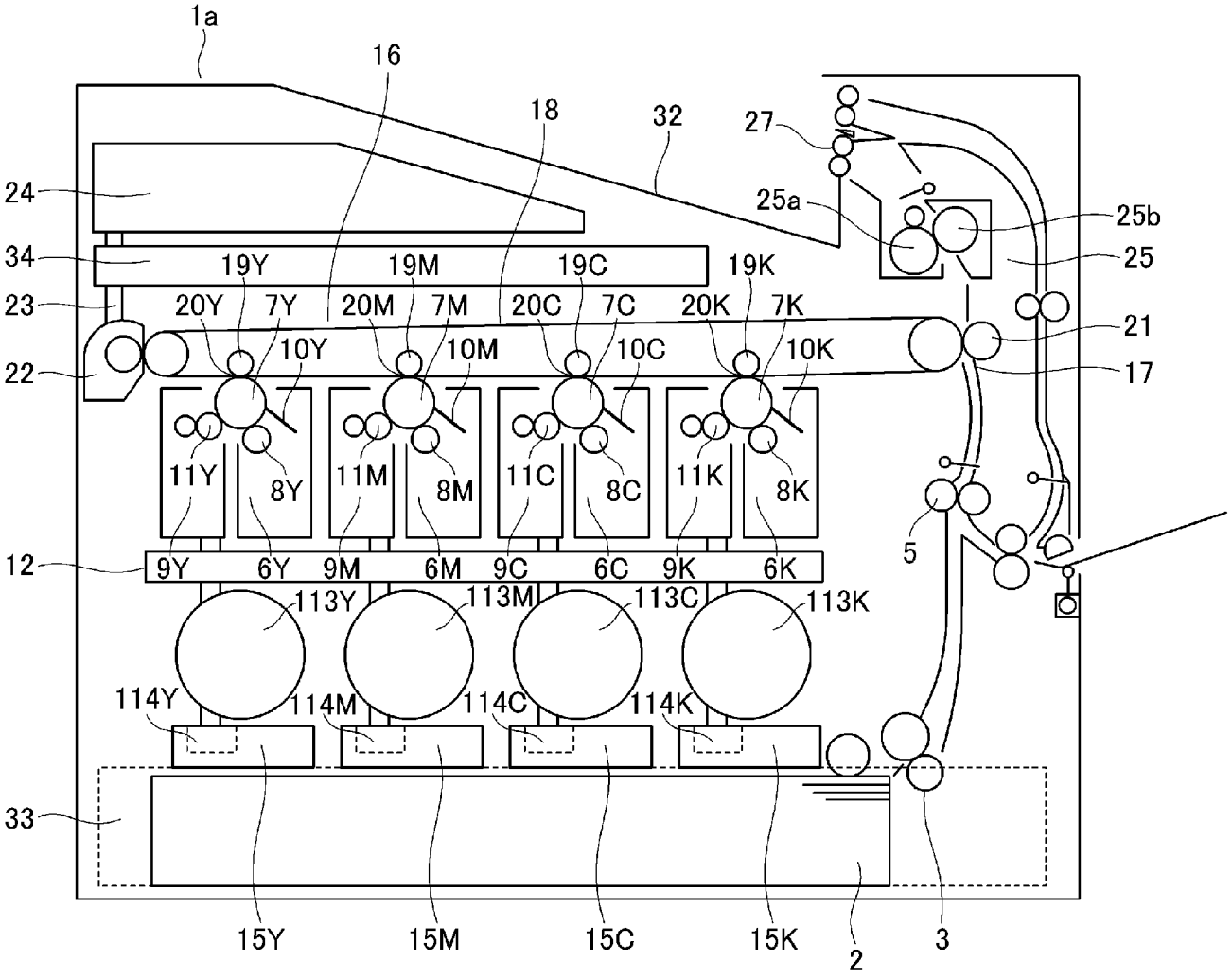
FIG. 10 is a schematic sectional view showing an overall configuration of an image forming apparatus 1*a* according to a second embodiment.

An image forming apparatus 1*a* according to a second embodiment of the present invention will be described with reference to FIG. 10. FIG. 10 is a main sectional view showing an overall configuration of the image forming apparatus 1*a* according to the second embodiment.

In the configuration of the image forming apparatus 1*a* according to the second embodiment, components in common with those of the image forming apparatus 1 according to the first embodiment are assigned same reference characters and reiterative descriptions thereof will be omitted. It is to be understood that matters not particularly mentioned in the second embodiment are similar to those described in the first embodiment.

For example, with respect to (Paper feed), (Image forming portion), (Transfer), (Fixing, paper discharge), and (Power supply apparatus) described above in the image forming apparatus 1 according to the first embodiment, since the image forming apparatus 1*a* according to the second embodiment shares similar configurations, descriptions thereof will be omitted.

Toner Replenishing Cartridge

As shown in FIG. 10, in the present embodiment, toner replenishing cartridges 113Y, 113M, 113C, and 113K (a toner replenishing cartridge 113) are similarly arranged approximately horizontally between the scanner unit 12 and the cassette 2. The inside of the toner replenishing cartridge 113 is filled with replenishing toner that corresponds to each color. Toner transport apparatuses 114Y, 114M, 114C, and 114K (a toner transport apparatus 114) transport, in an upward direction, toner received from the toner replenishing cartridge 113 and supplies the developing apparatus 9 with the toner. The toner transport apparatus 114 is driven by toner transport driving apparatuses 115Y, 115M, 115C, and 115K (a toner transport driving apparatus 115) arranged below the toner transport apparatus 114. A detailed description of the toner transport apparatus 114 will be provided later.

Toner Replenishing Cartridge

Figure 11A:
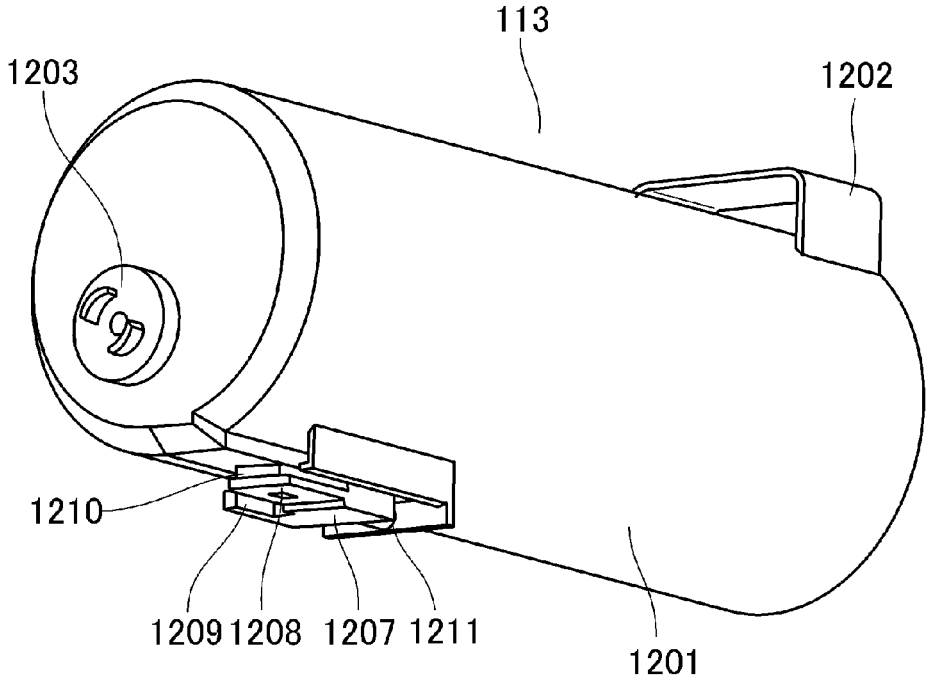
FIGS. 11A to 11D are perspective views of a toner replenishing cartridge 113 according to the second embodiment.
Figure 11B:
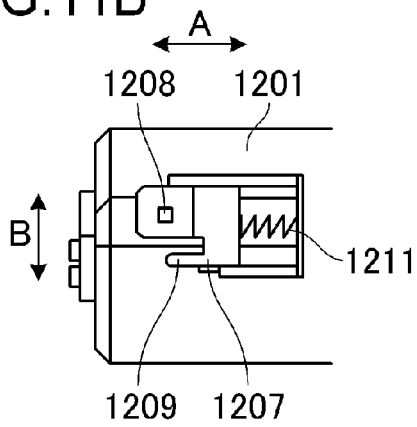

The toner replenishing cartridge 113 that is a characteristic component of the second embodiment will now be described with reference to FIGS. 11A to 11D. FIG. 11A is a perspective view of the toner replenishing cartridge 113 as seen from a rear side, FIG. 11B is a partial sectional view of the toner replenishing cartridge 113, and FIG. 11C is a lower view of the toner replenishing cartridge 113.

Figure 11C:
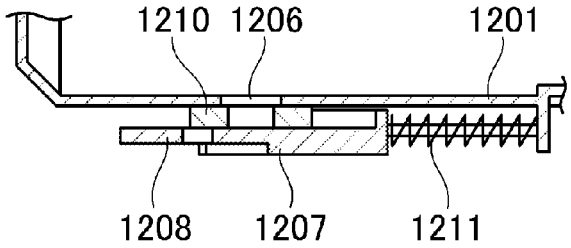
Figure 11D:
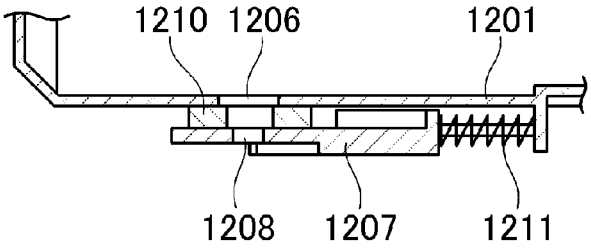

As shown in FIGS. 11A to 11D, the toner replenishing cartridge 113 has a container main body (a replenishing frame body) 1201 with an approximately cylindrical shape in a longitudinal direction, in which toner is housed inside the container main body 1201. While a configuration in which the container main body 1201 has an approximately cylindrical shape will be described in the present embodiment, the shape of the container main body 1201 is not limited thereto. For example, an effect of the present invention remains unchanged even in the case of a rectangular parallelepiped shape. A handle 1202 is formed in a front wall portion of the toner replenishing cartridge 113. The toner replenishing cartridge 113 can be attached to and detached from the apparatus main body of the image forming apparatus 1*a* while holding the handle 1202. A drive coupling 1203 is rotatably provided on a rear wall surface of the toner replenishing cartridge 113. The drive coupling 1203 is coupled to a screw (not illustrated) inside the container main body 1201, and when the toner replenishing cartridge 113 is mounted inside the image forming apparatus 1*a*, drive is transmitted as the drive coupling 1203 engages with a main body-side drive coupling (not illustrated). A supply port 1206 for supplying toner is formed on a rear wall side of a lower wall portion of the container main body 1201. A shutter 1207 and a seal 1210 that is an elastic member for filling a gap between the supply port 1206 and the shutter 1207 are provided around the supply port 1206. The seal 1210 has a hole that is larger than the supply port 1206, and the seal 1210 is fixed in close contact to the container main body 1201 by a double-sided tape so as to communicate with the supply port 1206. In addition, the shutter 1207 is biased by a biasing member 1211 and slidably held with respect to the container main body 1201 at a position where the shutter 1207 comes into close contact with the seal 1210. As shown in FIG. 11C, the shutter 1207 is provided with a supply port 1208 and a restricted portion 1209 that guides the shutter 1207 when the toner replenishing cartridge 113 is mounted to the image forming apparatus 1*a* and the shutter 1207 is slidably held in a longitudinal direction A in a state where there is play in a transverse direction B of the container main body 1201, whereby the supply port opens or closes as the shutter 1207 slides. When the toner replenishing cartridge 113 is not mounted to the image forming apparatus 1*a*, the shutter 1207 closes a replenishing port. FIG. 11D is a partial sectional view of the toner replenishing cartridge 113 when the toner replenishing cartridge 113 is mounted to the image forming apparatus 1*a*. As shown in FIG. 11D, when the toner replenishing cartridge 113 is mounted to the image forming apparatus 1*a*, the supply port 1206 and the supply port 1208 communicate with each other.

Details of Toner Transport Apparatus 114

Figure 12A:
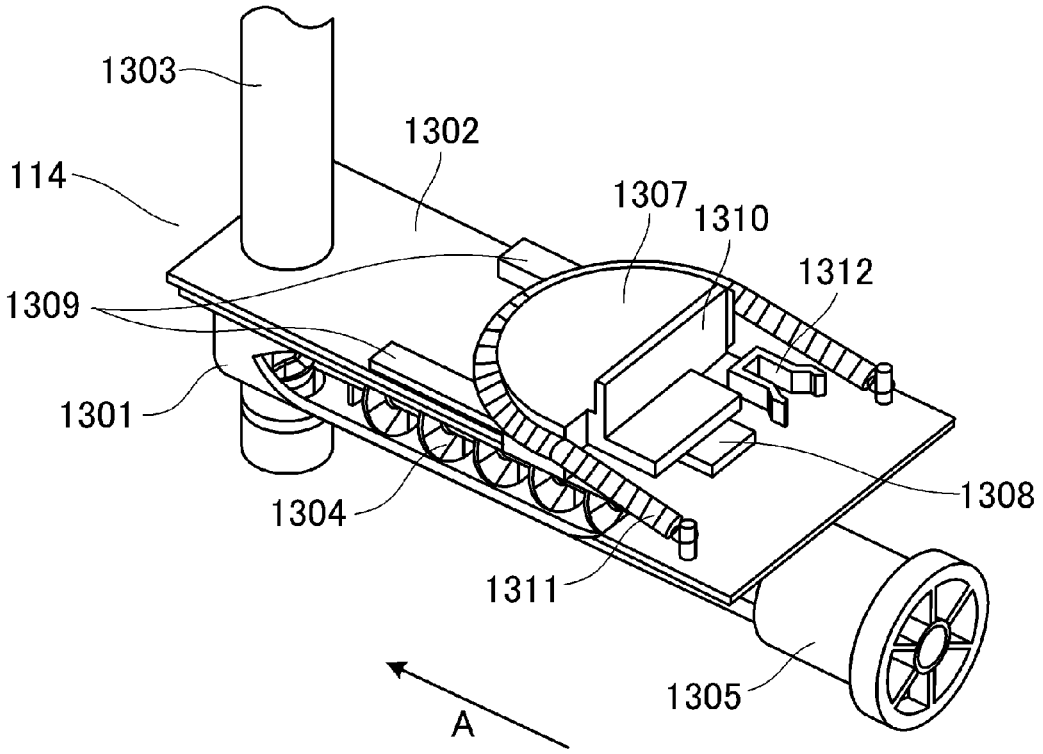
FIGS. 12A and 12B are perspective views of a toner transport apparatus 114 according to the second embodiment.
Figure 12B:
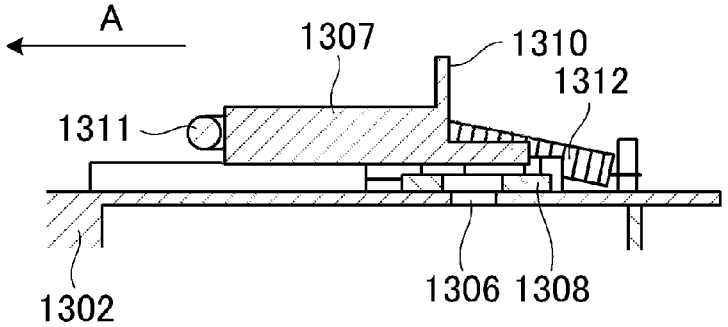

Details of the toner transport apparatus 114 will be described with reference to FIGS. 12A and 12B. FIG. 12A is a perspective view in which the toner transport apparatus 114 is seen from the front and FIG. 12B is a partial sectional view of the toner transport apparatus 114. As shown in FIG. 12A, the toner transport apparatus 114 constitutes a duct for transporting toner with a toner receiving container 1301, a cover 1302, and a longitudinal transport pipe 1303. In FIGS. 12A and 12B, for the sake of brevity, the inside of the duct is made visible by cutting away a portion of a shape thereof. A toner horizontal transport member 1304 is a resin screw having a spiral shape and is individually housed so as to be rotatable inside the toner receiving container 1301. The toner horizontal transport member 1304 is rotated by a driving force transmitted by a horizontal screw drive gear 1305 that engages from outside of the toner receiving container 1301. It should be noted that effects produced by the present invention remain unchanged even if driving connecting means of the screw adopts modes that differ from that according to the present embodiment.

As shown in FIG. 12B, the cover 1302 has a toner receiving port 1306 that accepts toner replenished from the toner replenishing cartridge 113. A receiving portion shutter 1307 and a seal 1308 that is an elastic member between the toner receiving port 1306 and the receiving portion shutter 1307 are provided around the toner receiving port 1306. The seal 1308 has a hole that is larger than the toner receiving port 1306, and the seal 1308 is fixed in close contact by a double-sided tape to the cover 1302 so as to communicate with the toner receiving port 1306. In addition, the receiving portion shutter 1307 is provided so as to be slidable in a direction of an arrow A along a rail 1309 that is provided on the cover 1302. The receiving portion shutter 1307 has a contact portion 1310 and is biased by a spring 1311 to a position where the receiving portion shutter 1307 blocks the toner receiving port 1306 when the toner replenishing cartridge 113 is not mounted. Furthermore, the cover 1302 is provided with a restricting portion 1312 for engaging with, during mounting of the toner replenishing cartridge 113, the restricted portion 1209 of the shutter 1207 provided on the toner replenishing cartridge 113 to restrict a position of the toner replenishing cartridge 113.

Toner replenished from the toner replenishing cartridge 113 is replenished from the toner receiving port 1306 to the inside of the toner receiving container 1301 and transported to the developing apparatus 9 by the respective toner transport members.

Mounting Operation of Toner Replenishing Cartridge 113

Figure 13A:
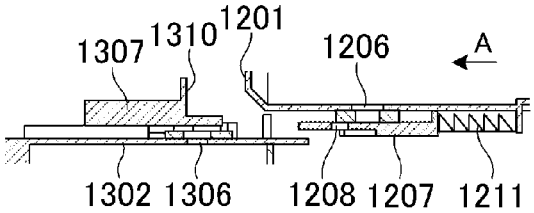
FIGS. 13A, 13B, 13C, 13D, 13E, and 13F are sectional views of a mounting process of the toner replenishing cartridge 113 according to the second embodiment.
Figure 13B:
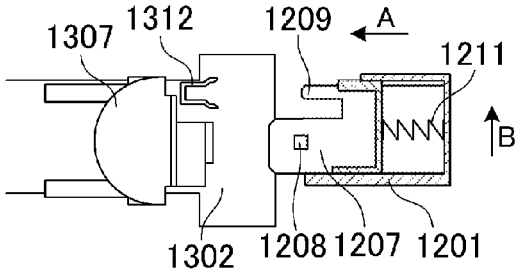
Figure 13C:
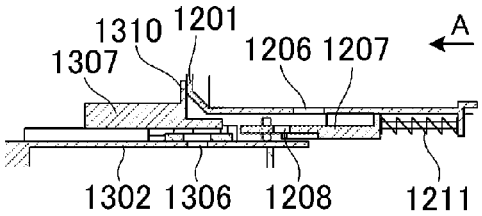
Figure 13D:
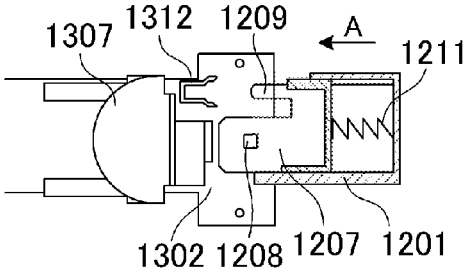
Figure 13E:
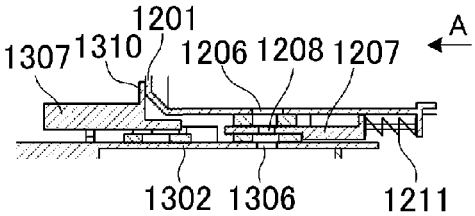
Figure 13F:
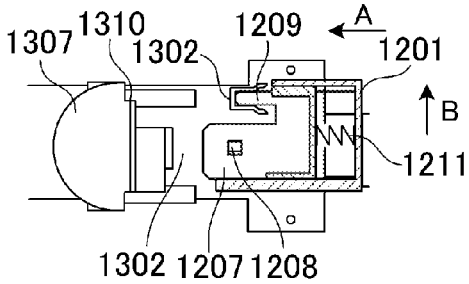

Next, a mounting operation of the toner replenishing cartridge 113 will be described with reference to FIGS. 13A to 13F. FIGS. 13A, 13C, and 13E are partial sectional views showing a process of the toner replenishing cartridge 113 being mounted to the image forming apparatus 1*a*. FIGS. 13B, 13D, and 13F are upper sectional views of the mounting process shown in FIGS. 13A, 13C, and 13E.

When the toner replenishing cartridge 113 has not been mounted, as shown in FIGS. 13A and 13B, the shutter 1207 is at a position where the shutter 1207 blocks the supply port 1206 of the container main body. When the toner replenishing cartridge 113 is inserted in the direction of the arrow A, as shown in FIGS. 13C and 13D, the container main body 1201 comes into contact with the contact portion 1310 of the shutter 1307 and the shutter 1307 starts to open. Furthermore, when the toner replenishing cartridge 113 is inserted in the direction of the arrow A, as shown in FIGS. 13E and 13F, the shutter 1307 is pressed by the toner replenishing cartridge 113 and opens in the A direction to expose the toner receiving port 1306. In addition, as the restricted portion 1209 of the shutter 1207 engages with the restricting portion 1312 of the cover 1302, a position of the shutter 1207 in the A direction and in a B direction that is perpendicular to the mounting direction is restricted and the toner supply port 1206, the toner supply port 1208, and the toner receiving port 1306 communicate with each other. After the restricted portion 1209 and the restricting portion 1312 come into contact with each other, the toner replenishing cartridge 113 further moves in the A direction and is positioned by positioning means (not illustrated). The shutter 1207 is held with play in a direction that is perpendicular to the mounting direction of the toner replenishing cartridge 113. Due to the engagement of the restricted portion 1209 and the restricting portion 1312, the position is restricted by the cover 1302 instead of the toner replenishing cartridge 113.

As described above, by restricting the position of the shutter 1207 of the toner replenishing cartridge 113 with the restricting portion 1312 that is a member of the toner transport apparatus 114, even when the position of the toner replenishing cartridge 113 varies, positional accuracy of the shutter 1207 does not change. Improving positional accuracy of the toner supply port 1206 with respect to the toner receiving port 1306 enables a pore diameter to be reduced and toner scattering when attaching and detaching the toner replenishing cartridge 113 can be prevented.

While a configuration in which the shutter 1207 is provided with the restricted portion 1209 having a convex shape and the cover 1302 is provided with the restricting portion 1312 having a concave shape has been described in the present embodiment, a similar effect can be produced by a configuration in which the convex and concave shapes are interchanged or a configuration that adopts different shapes.

Third Embodiment

A third embodiment of the present invention will be described with reference to FIGS. 14A and 14B. Moreover, portions similar to the components described in the second embodiment will be denoted by the same reference numerals and a description thereof will be omitted. The configuration of the toner replenishing cartridge according to the third embodiment is for preventing toner scattering during mounting of the toner replenishing cartridge 113 in a similar manner to the second embodiment and represents different shapes of a restricted portion of a shutter and a restricting portion for restricting a position of the shutter.

Figure 14A:
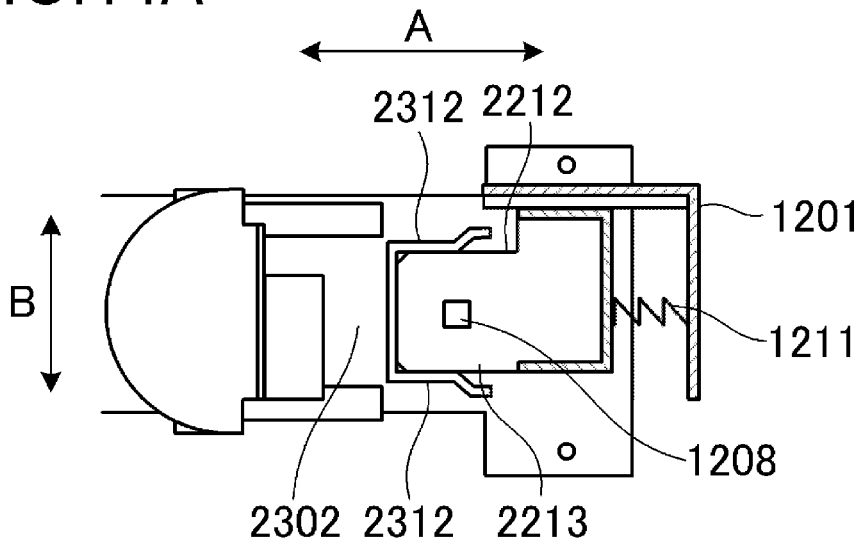
FIGS. 14A and 14B are explanatory diagrams of a configuration of a toner replenishing cartridge according to a third embodiment.
Figure 14B:
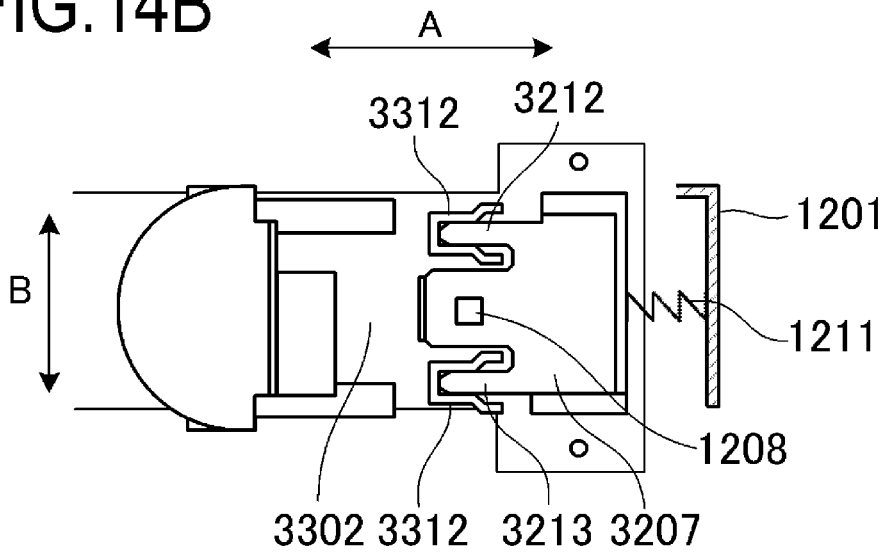

FIGS. 14A and 14B are upper sectional views of the toner replenishing cartridge according to the third embodiment when mounted to an image forming apparatus. As a restricting portion 2312 engages with a restricted portion 2212 and a restricted portion 2213 of the shutter 1207 during mounting of a toner container, a position of the shutter 1207 in the A direction and in the B direction that is perpendicular to the mounting direction is restricted in a similar manner to the second embodiment.

In FIG. 14A, an outer shape portion of the shutter performs roles of the restricted portion 2212 and the restricted portion 2213 and, in FIG. 14B, convex shapes at two locations form a restricted portion 3212 and a restricted portion 3213. In either configuration, engaging portions (restricting portions) of the shutter 1207 and the cover 1302 are arranged on both sides of the toner supply port 1208 in the B direction (the direction having play) that is perpendicular to the mounting direction, and the engaging portions function as guide portions that guide a relative movement of the shutter 1207 with respect to the cover 1302 to a final engagement position. Therefore, in the third embodiment, by arranging the toner supply port 1208 between the two restricted portions 3212 and 3213 in the B direction that is perpendicular to the mounting direction, an effect of an inclination of the shutter 1207 relative to the cover 1302 with respect to the position of the toner supply port 1208 can be suppressed. Therefore, the position of the toner supply port 1208 can be more stabilized than in the second embodiment.

Fourth Embodiment

A fourth embodiment of the present invention will be described with reference to FIG. 15. Moreover, portions similar to the components described in the first embodiment will be denoted by the same reference numerals and a description thereof will be omitted. The configuration of the toner replenishing cartridge according to the fourth embodiment is for preventing toner scattering during mounting of the toner replenishing cartridge 113 in a similar manner to the second embodiment and represents different shapes of a restricted portion of a shutter and a restricting portion for restricting a position of the shutter.

Figure 15:
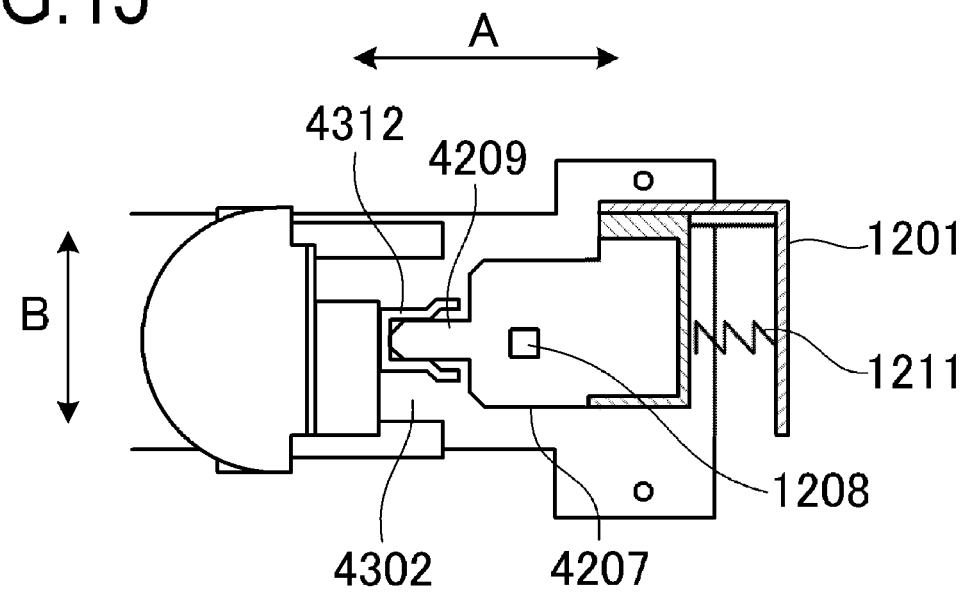
FIG. 15 is an explanatory diagram of a configuration of a toner replenishing cartridge according to a fourth embodiment.

FIG. 15 is an upper sectional view of the toner replenishing cartridge according to the fourth embodiment when mounted to an image forming apparatus. As a restricting portion 4312 engages with a restricted portion 4209 of the shutter 1207 during mounting of a toner container, a position of the shutter 1207 in the A direction and in the B direction that is perpendicular to the mounting direction is restricted in a similar manner to the second embodiment. In the second embodiment, in an arrangement in a view perpendicular to a paper plane in FIGS. 13A to 13F, the biasing member 1211 and the toner supply port 1208, and the restricted portion 4209, are arranged in a displaced manner with respect to the B direction that is perpendicular to the mounting direction of the toner replenishing cartridge. In contrast, in the fourth embodiment, in an arrangement in a view perpendicular to a paper plane in FIG. 15, the biasing member 1211 and the toner supply port 1208, and the restricted portion 4209, are arranged coaxially with respect to the mounting direction. In other words, in a direction having play (a horizontal direction that is perpendicular to the mounting direction) between the shutter 4207 and the container main body 1201, the biasing member 1211 and the toner supply port 1208, and the restricted portion 4209, are arranged at approximately matching positions. Accordingly, in the fourth embodiment, an inclination (an occurrence of moment) of the shutter 1207 by the biasing member 1211 can be suppressed and the position of the toner supply port 1208 can be more stabilized in comparison to the second embodiment.

Configurations of the respective embodiments described above can be mutually combined to the greatest extent feasible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-168876, filed on Sep. 17, 2019, which is hereby incorporated by reference herein in its entirety.

What is claimed is:

1. A cartridge attachable to and detachable from an apparatus main body of an image forming apparatus, the apparatus main body having a restricting portion and to which the cartridge is mounted by being moved from an unmounted position to a mounting-completed position in a first direction, the cartridge comprising:

a developer container which houses a developer and provided with a supply port for supplying the developer to the apparatus main body; and a shutter configured to be movable, with respect to the developer container, between an opening position for opening the supply port and a closing position for closing the supply port, the shutter having a restricted portion and being configured to be in the closing position when the cartridge is in the unmounted position and be in the opening position when the cartridge is in the mounting-completed position, wherein a movement of the shutter in a second direction perpendicular to the first direction is restricted by an engagement between the restricting portion of the apparatus main body and the restricted portion when the cartridge is in the mounting-completed position.

2. The cartridge according to claim 1, wherein a movement of the shutter in the first direction with respect to the apparatus main body is restricted by an engagement between the restricting portion of the apparatus main body and the restricted portion.

3. The cartridge according to claim 1, wherein the shutter has a communication hole, and the communication hole is configured to communicate with the supply port when the shutter is in the opening position and not to communicate with the supply port when the shutter is in the closing position.

4. The cartridge according to claim 3, wherein the apparatus main body has a receiving port for receiving a toner from the cartridge, and wherein the communication hole is configured not to communicate with the receiving port when the cartridge is in the unmounting position and communicate with the receiving port when the cartridge is in the mounting-completed position.

5. The cartridge according to claim 4, wherein a movement direction of the shutter between the opening position and the closing position is a direction along with the first direction, and wherein the shutter is assembled with respect to the developer container so as to have play in the second direction.

6. The cartridge according to claim 5, wherein the supply port and the communication hole overlap with each other in a direction perpendicular to the first direction and the second direction when the developer container is at the mounting-completed position, wherein the communication hole is smaller than the supply port, and wherein the supply port has a size that enables communication with the receiving port via the communication hole to be maintained regardless of a size of the play.

7. The cartridge according to claim 5, wherein the restricted portion includes a first contact portion that comes into contact with the restricting portion in a first orientation in the second direction and a second contact portion that comes into contact with the restricting portion in a second orientation that is opposite to the first orientation in the second direction.

8. The cartridge according to claim 7, wherein the first contact portion and the second contact portion are arranged on a first side in the second direction with respect to the communication hole.

9. The cartridge according to claim 7, wherein the first contact portion is arranged on a first side in the second direction with respect to the communication hole, and wherein the second contact portion is arranged on a second side that is opposite to the first side in the second direction with respect to the communication hole.

10. The cartridge according to claim 7, wherein positions of the first contact portion and the second contact portion in the first direction overlap with a position of the communication hole in the first direction.

11. The cartridge according to claim 7, wherein the first contact portion and the second contact portion are arranged at positions that are displaced in the first direction with respect to the communication hole.

12. The cartridge according to claim 11, wherein a position of the restricted portion in the second direction approximately matches a position of the communication hole in the second direction.

13. The cartridge according to claim 5, wherein the shutter includes a plurality of restricted portions in correspond with a plurality of restricting portions which are provided on the apparatus main body.

14. The cartridge according to claim 13, wherein the plurality of restricted portions include a restricted portion that is arranged on a first side of the communication hole and a restricted portion that is arranged on a second side of the communication hole in the second direction.

15. The cartridge according to claim 5, wherein the restricted portion is configured in a concave shape into which the restricting portion with a convex shape is inserted in a direction opposed to the first direction.

16. The cartridge according to claim 5, wherein when the developer container moves from the unmounted position toward the mounting-completed position, the shutter relatively moves with respect to the developer container as the restricted portion engages with the restricting portion and the shutter changes from the closing position to the opening position.

17. The cartridge according to claim 5, wherein the supply port first overlaps with the receiving port when the restricted portion engages with the restricting portion and, subsequently, also overlaps with the supply port when the developer container reaches the mounting-completed position to connect the supply port with the receiving port.

18. The cartridge according to claim 5, wherein the communication hole is designated as a first communication hole, wherein the developer container includes an elastic member which is provided so as to be slidable with respect to the shutter between the developer container and the shutter and which includes a second communication hole that connects the first communication hole with the supply port when the shutter is in the opening position, and wherein the second communication hole is smaller than the supply port but larger than the first communication hole.

19. An image forming apparatus, comprising:

an apparatus main body including an image forming portion that forms an image on a recording material using a developer and a receiving port for receiving replenishment of the developer; and a cartridge attachable to and detachable from the apparatus main body, the apparatus main body having a restricting portion and to which the cartridge is mounted by being moved from an unmounted position to a mounting-completed position in a first direction, the cartridge comprising:

a developer container which houses a developer and provided with a supply port for supplying the developer to the apparatus main body; and a shutter configured to be movable, with respect to the developer container, between an opening position for opening the supply port and a closing position for closing the supply port, the shutter having a restricted portion and being configured to be in the closing position when the cartridge is in the unmounted position and be in the opening position when the cartridge is in the mounting-completed position, wherein a movement of the shutter in a second direction perpendicular to the first direction is restricted by an engagement between the restricting portion of the apparatus main body and the restricted portion when the cartridge is in the mounting-completed position.

20. The image forming apparatus according to claim 19, wherein a movement of the shutter in the first direction with respect to the apparatus main body is restricted by an engagement between the restricting portion of the apparatus main body and the restricted portion.

21. The image forming apparatus according to claim 19, wherein the shutter has a communication hole, and the communication hole is configured to communicate with the supply port when the shutter is in the opening position and not to communicate with the supply port when the shutter is in the closing position.

22. The image forming apparatus according to claim 21, wherein the communication hole is configured to not to communicate with the receiving port when the cartridge is in the unmounting position and communicate with the receiving port when the cartridge is in the mounting-completed position.

23. The image forming apparatus according to claim 22, wherein the shutter is designated as a first shutter, wherein the apparatus main body includes:

a developer receiving portion which is provided with the receiving port and which receives a developer via the receiving port; and a second shutter which is assembled so as to be relatively movable with respect to the developer receiving portion so as to open and close the receiving port, and wherein the second shutter is pressed by the developer container and relatively moves with respect to the developer receiving portion to change from a closing position where the receiving port is closed to an opening position where the receiving port is exposed as the developer container moves from the unmounted position toward the mounting-completed position.

24. The image forming apparatus according to claim 23, wherein before the supply port of the developer container overlaps with the communication hole of the first shutter and becomes exposed, the second shutter moves to the opening position and exposes the receiving port of the developer receiving portion.

25. The image forming apparatus according to claim 23, wherein the communication hole of the first shutter is designated as a first communication hole, wherein the developer receiving portion includes a second elastic member which is provided so as to be slidable with respect to the second shutter between the developer receiving portion and the second shutter and which includes a third communication hole that connects the first communication hole with the receiving port when the second shutter is in the opening position and, at the same time, the first shutter is in the opening position, and wherein the third communication hole is larger than the receiving port and the first communication hole.

* * * * *